US010235894B2

(12) United States Patent
Chartier et al.

(10) Patent No.: US 10,235,894 B2
(45) Date of Patent: Mar. 19, 2019

(54) ADVISOR SYSTEM AND METHOD

(71) Applicant: Architecture Technology Corporation, Minneapolis, MN (US)

(72) Inventors: Eric R. Chartier, St. Louis Park, MN (US); Evan Eaves, Alexandria, VA (US); William Colligan, Vienna, VA (US); Andrew Murphy, Washington, DC (US)

(73) Assignee: ARCHITECTURE TECHNOLOGY CORPORATION, Minneapolis, MN (US)

( * ) Notice: Subject to any disclaimer, the term of this patent is extended or adjusted under 35 U.S.C. 154(b) by 0 days.

(21) Appl. No.: 16/055,557

(22) Filed: Aug. 6, 2018

(65) Prior Publication Data

US 2018/0357911 A1 Dec. 13, 2018

Related U.S. Application Data

(63) Continuation of application No. 15/458,052, filed on Mar. 14, 2017, now Pat. No. 10,043,405.

(51) Int. Cl.
*G08G 5/04* (2006.01)
*G08G 5/00* (2006.01)

(52) U.S. Cl.
CPC ..... *G08G 5/045* (2013.01); *G08G 5/0008* (2013.01); *G08G 5/0013* (2013.01); *G08G 5/0021* (2013.01); *G08G 5/0026* (2013.01); *G08G 5/0052* (2013.01); *G08G 5/0078* (2013.01)

(58) Field of Classification Search
CPC .... G08G 5/045; G08G 5/0013; G08G 5/0026; G08G 5/0052; G08G 5/0021; G08G 5/0008; G08G 5/0078
See application file for complete search history.

(56) References Cited

U.S. PATENT DOCUMENTS 8,914,205 B2 * 12/2014 Chandran ..... G06F 17/00 701/31.4
2018/0061252 A1 * 3/2018 Feng ..... G08G 5/045

* cited by examiner

*Primary Examiner* — Adnan Aziz

(57) ABSTRACT

An advisor system includes a computer-readable storage medium having encoded thereon a program of instructions. Execution of the instructions causes a processor to determine a current state of a first aircraft operating on a movement area of an airport including determining a path vector for the first aircraft. The path vector includes a speed and direction of travel of the first aircraft and identification of a runway intersection the first aircraft is projected to enter. The processor processes a surveillance signal transmitted from a second aircraft operating on the movement area, including determining a quality of the surveillance signal. The processor further determines a movement vector of the second aircraft, and compares the path vector and the movement vector to identify possible interference. Finally, the processor provides an advisory at the first aircraft based on the compared path vector and the movement vector.

18 Claims, 17 Drawing Sheets

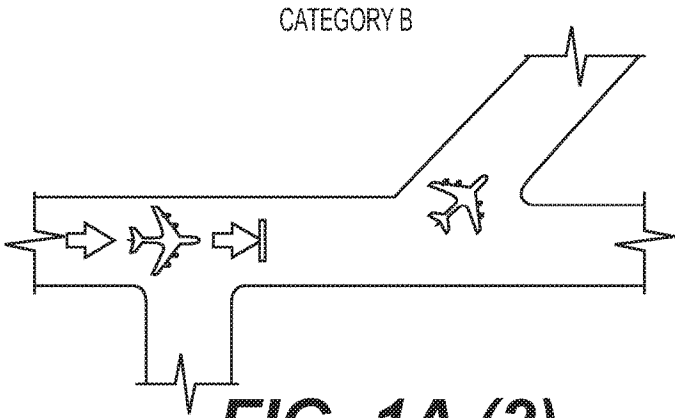
FIG. 1A (1)
FIG. 1A (2)
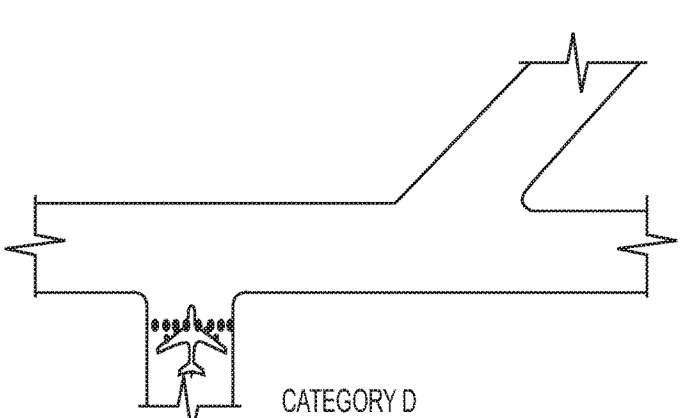
FIG. 1A (3)
FIG. 1A (4)

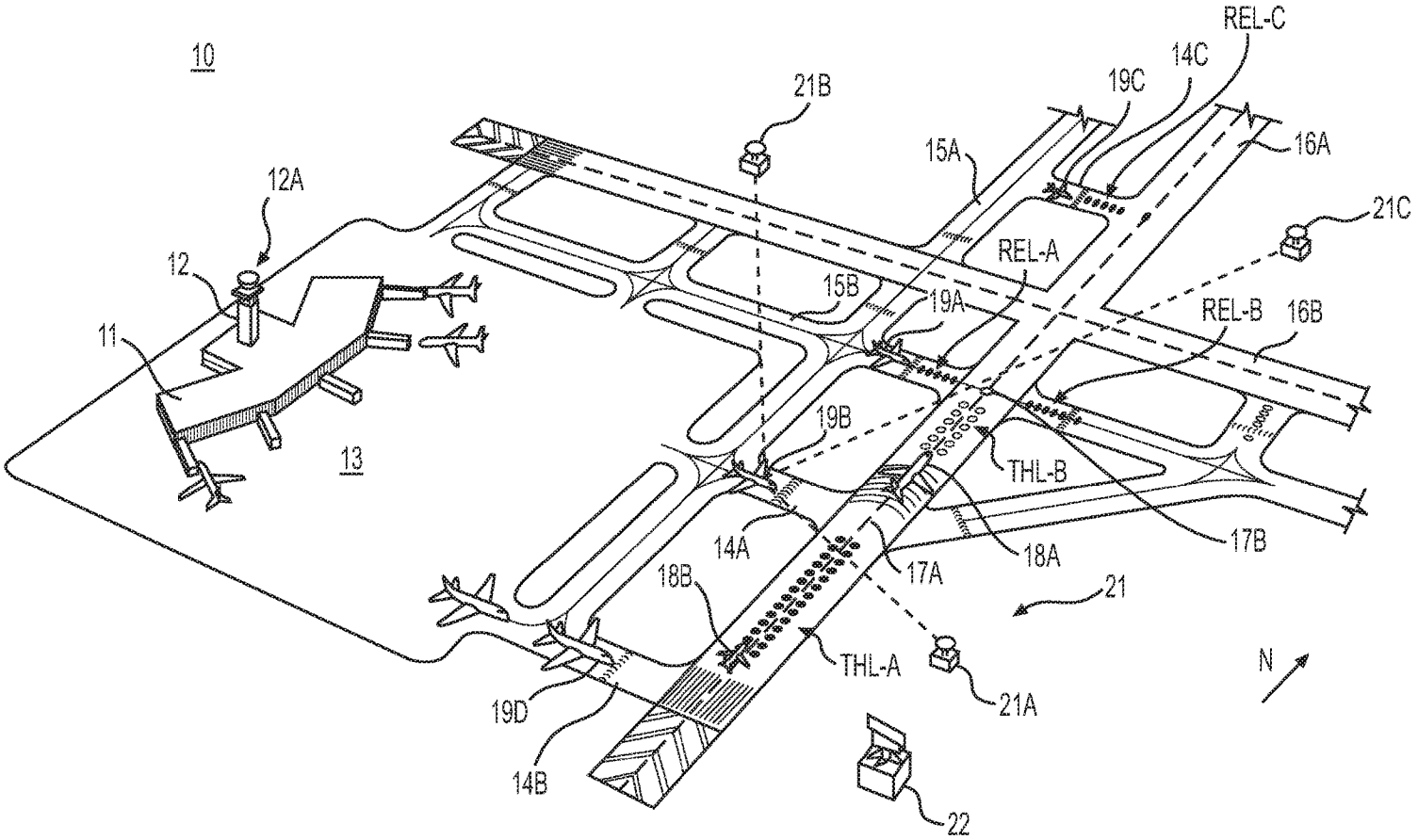
FIG. 1B (1)

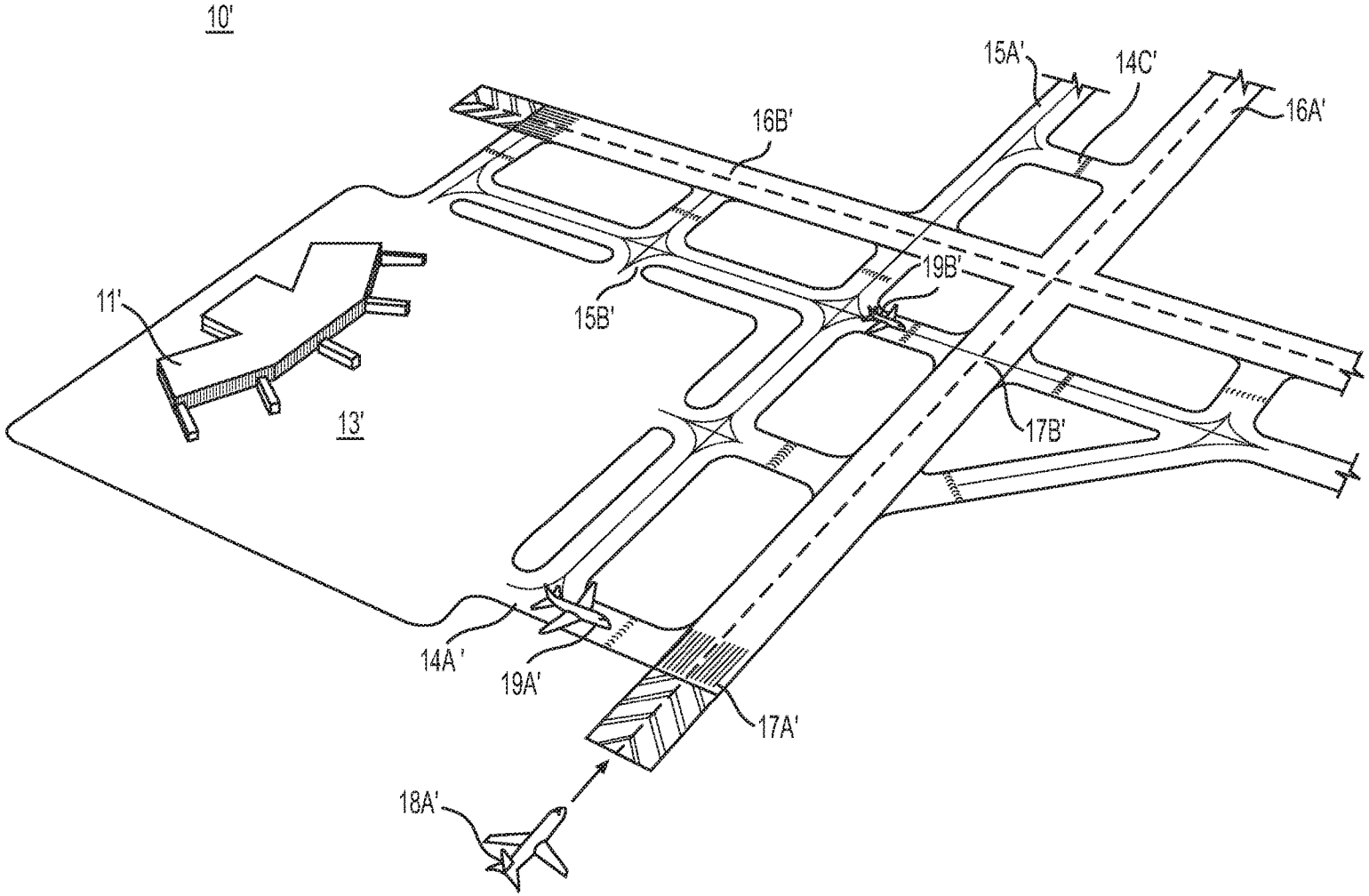
FIG. 1B (2)

ADVISOR SYSTEM AND METHOD

RELATED APPLICATIONS

This application is a continuation of U.S. patent application Ser. No. 15/458,052, filed Mar. 14, 2017, entitled "Advisor System and Method." The content of this patent application is incorporated by reference.

BACKGROUND

The International Civil Aviation Organization (ICAO) defines a runway incursion as "Any occurrence at an aerodrome involving the incorrect presence of an aircraft, vehicle, or person on the protected area of a surface designated for the landing and take-off of aircraft." The U.S. Federal Aviation Administration (FAA) adopted the ICAO definition in October 2007. Runway incursions obviously create the risk that an airplane taking off or landing will collide with whatever object is on the runway. The Mar. 27, 1977 Tenerife airport disaster, in which 583 people were killed in the deadliest aviation accident in history, began with a runway incursion.

Airport surface monitoring began with simple visual monitoring by air traffic controllers. Later systems invoked surface radar and multilateration. Surface radar and multilateration systems address a significant component of the ground control requirements; however, neither system alone provides a comprehensive solution as limitations exist with each system. In the case of surface radar, blind spots, multipathing, antenna period, and clutter tend to affect the usability of the system. In the case of multilateration (MLAT), targets without an active transponder will not be detected or tracked by the system. Some pilots off their transponders after landing or aircraft automatically disable the transponder on the ground, which renders them invisible to the MLAT system. Furthermore, most airport vehicles do not have transponders. Accordingly, the information presented to the air traffic personnel can be incomplete or inaccurate, thereby leading to potential safety issues since a properly tracked vehicle or aircraft could be directed to an area where an undetected aircraft may be residing.

Following the Tenerife disaster, aviation authorities looked past surface search radars to find systems and implement procedures and to better improve runway safety by limiting runway incursions. For example, in the U.S., systems such as Airport Surface Detection Equipment—Model X (ASDE-X) and Airport Surface Surveillance Capability (ASSC) have improved airport surface safety and efficiency with surveillance and safety alerts for air traffic control (ATC), but these systems are installed only at the largest U.S. airports. ASDE-X is deployed at 35 airports and ASSC will be deployed at 9 additional. Installation of these systems at additional airports is not currently planned. In contrast to air traffic controller alerting systems, the FAA's Runway Status Lights (RWSL) system addresses runway safety by directly providing aircraft and ground vehicles with improved situational awareness. RWSL uses automatically controlled in-pavement lights to signal the pilot if it is unsafe to enter the runway. RWSL is a fully automatic, advisory safety system designed to reduce the number and severity of runway incursions and prevent runway accidents while not interfering with airport operations. RWSL is designed to be compatible with existing procedures and to operate without adding to air traffic controller workload. RWSL uses surveillance sources (such as ASDE-X or ASSC), light control logic, and a Field Lighting Subsystem (FLS) with arrays of in-pavement light fixtures. The FLS provides RWSL with two types of lights: Runway Entrance Lights (REL) and Takeoff Hold Lights (THL). Normally, the REL and THL lights are extinguished. REL illuminate red when it is unsafe to enter the runway. THL lights illuminate red when it is unsafe to begin departure. A pilot still requires a clearance from the controller to enter or cross a runway or begin a departure. Thus, RWSL provides an additional, independent layer of safety, but use of FLS adds greatly to the cost and complexity of RWSL. For example, a typical FLS may involve multiple power shelters, constant current airfield lighting circuits, and several hundred in-pavement light locations—each with fixture, addressable controller, and power transformer components installed. Maintenance is a significant expense over the lifecycle of the system due to the harsh airport runway environment's effect on the FLS equipment. The RWSL program only includes 17 major airports (15 are currently operational). As reported in FAA Operational and Programmatic Deficiencies Impede Integration of Runway Safety Technologies", Office of the Inspector General (OIG) Audit Report, AV-2014-060, Jun. 26, 2014, Page 2, available at https://www.org.dot.gov/sites/default/files/FAA%20Surface%20Surveillance%20Technologies%5E6-26-14.pdf, technical problems and unexpected costs related to the construction and operation of the in-pavement FLS delayed implementation significantly and contributed to the decision to remove six airports from the original implementation plan. This leaves hundreds of other airports without the safety benefits of RWSL. A way to provide the RWSL safety benefits to pilots without relying on costly FLS and related infrastructure is needed.

One current or soon to be implemented system that may be leveraged to assist in runway incursion prevention is the Automatic Dependent Surveillance-Broadcast system (ADS-B). ADS-B is the foundation of the FAA's Next General Air Transportation System (NextGen), a satellite-based system that was implemented to make the nation's airspace more efficient. There are two types of ADS-B service that may be implemented on an airplane: ADS-B Out and ADS-B In. Both are valuable, but as of 2015, only ADS-B Out is mandated by the FAA's Final Rule, which states that all aircraft operating in designated airspace must be equipped with ADS-B Out by Jan. 1, 2020. ADS-B will allow air traffic controllers and other participating aircraft to receive extremely accurate information about an aircraft's location and flight path, which, in turn will allow for safer operations, reduced separation standards between aircraft, more direct flight routes and cost savings for operators. ADS-B Out is the "broadcast" part of ADS-B. An aircraft equipped with ADS-B Out capability will continuously transmit aircraft data, such as airspeed, altitude and location, to other aircraft with ADS-B In service and to ADS-B ground stations. ADS-B ground stations provide additional information in their ADS-B broadcasts, possibly including the position reports of non-ADS-B Out equipped aircraft if they are detected by other FAA cooperative (secondary surveillance radar (SSR) and FAA non-cooperative surveillance systems (e.g., radar-based). The minimum equipment needed for ADS-B Out capability includes an ADS-B-approved transmitter—either a 1090 MHz Mode S transponder or a dedicated 978 MHz UAT for use with a previously installed Mode C or Mode S transponder—and a WAAS-enabled GPS system. ADS-B In is the receiver part of the system. ADS-B In equipment allows aircraft, when equipped properly, to receive and interpret other participating aircraft's ADS-B Out data on a computer screen or an Electronic Flight Bag in the cockpit.

An electronic flight bag (EFB) is an electronic information management device that helps flight crews perform flight management tasks more easily and efficiently with less paper. An EFB is a general-purpose computing platform intended to reduce, or replace, paper-based reference material often found in the pilot's carry-on flight bag, including the aircraft operating manual, flight-crew operating manual, and navigational charts (including moving map for air and ground operations).

SUMMARY

An advisor system includes a receiver, installed on a mobile first platform, that receives one or more signals from a signal sources installed on a mobile second platform, the signals conforming to one or more types of surveillance signals; a processor, coupled to the receiver, that processes a given signal of a given signal type to produce signal data; and a non-transitory computer-readable storage medium having encoded thereon a program of instructions. A processor executes the instructions to determine a first path vector for the mobile first platform, determine a quality factor associated with the given signal, and based on the qualify factor, analyze the signal data from the given signal to identify a threat to the mobile first platform, comprising the processor: determining a second path vector for the moving second platform; identifying the second path vector within a minimum proximity value of the first path vector; and providing an advisory to the mobile first platform.

A mobile runway advisor system (MoRA) includes a non-transitory, computer-readable storage medium having encoded thereon a program of instruction that when executed by a processor cause the processor to determine a current state of a first aircraft, operating on a movement area of an airport, including determining a path vector for the first aircraft, the path vector including a speed and direction of travel of the first aircraft on the movement area; process a surveillance signal transmitted from a second aircraft operating on the movement area to determine a possible interference of the first aircraft by the second aircraft including determining a quality of the surveillance signal, based on the quality determination, determining a movement vector of the second aircraft, and comparing the path vector and the movement vector to identify the possible interference; and providing an advisory at the first aircraft based on the compared path vector and the movement vector.

A computer-implemented runway advisory method includes receiving ownship data for a first aircraft operating on a movement area of an airport; a processor computing a path vector for the first aircraft based on the received ownship data; receiving data extracted from a surveillance signal, the data comprising position and velocity data related to a second aircraft; the processor analyzing a portion of the extracted data to determine a quality of the surveillance signal; based on the determined quality, the processor computing a movement vector for the second aircraft; the processor comparing the path vector and the movement vector to determine an interference with the first aircraft by the second aircraft; and based on the comparison, the processor generating an advisory signal indicative of the interference.

DESCRIPTION OF THE DRAWINGS

The detailed description refers to the following figures in which like numerals refer to like items, and in which:

FIGS. 1A(1)-1A(4) illustrate runway incursion categories;

FIGS. 1B(1) and 1B(2) illustrate airport environments in which example mobile runway advisory systems may be implemented;

DETAILED DESCRIPTION

Figure 1C:
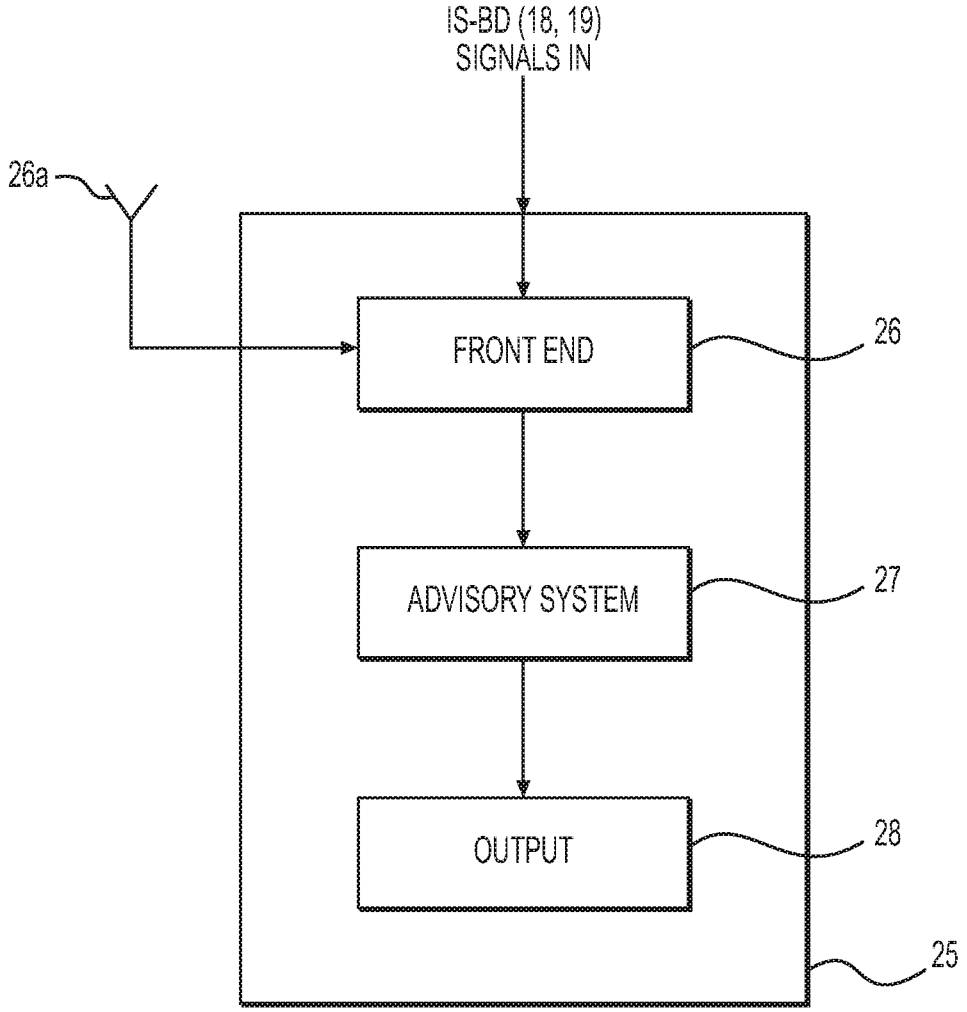
FIG. 1C is a block diagram that illustrates an example mobile runway advisory system.

Following the 1977 Tenerife disaster, aviation authorities implemented procedures and installed systems designed to improve runway safety and limit runway incursions. Despite these efforts, as can be seen in Table 1, runway incursions (see FIG. 1A for a graphical representation of runway incursion types) are on the rise. FIGS. 1A(1)-1A(4) illustrate types or categories A-D of runway incursions. In FIG. 1A(1), the most severe, category A, is defined as a serious incident in which a collision is narrowly avoided. FIG. 1A(2) illustrates category B in which aircraft separation decreases to the point where there is a serious potential for collision and in which time-critical corrective/evasive response is required to avoid collision. FIG. 1A(3) illustrates category C in which ample time and/or distance is available to avoid a collision. FIG. 1A(4) illustrates category D in which an incursion occurs but with no immediate safety consequences. The data in Table 1 show that while the more severe (type A and B) runway incursions do not seem to follow a consistent trend, the number of flight operations per year has been on the decline, meaning the number of incursions per unit of flight operations is increasing. A recent analysis reports that the rate of type A and type B incursions has been "steadily on the rise since the start of fiscal 2013, when the rate was 0.23 incursions per million operations. As of this July [2016], the rate was up to 0.375, just shy of the FAA's target maximum rate of 0.395." Another FAA report states that, on average between three and four runway incursions occur daily in the U.S., and among the risk factors that contribute to the problem are unclear runway markings and airport signage as well as more complex causes such as runway or taxiway layout.

TABLE 1

| Year | Type A | Type B | Type C | Type D | Total A + B + C + D | Unclassified Runway Incursions | Total A + B | Total A + B at RWSL | Total A + B at non RWSL | % of A + B at non RWSL |
|---|---|---|---|---|---|---|---|---|---|---|
| FY2012 | 7 | 11 | 491 | 639 | 1148 | 0 | 18 | 2 | 16 | 89% |
| FY2013 | 2 | 9 | 506 | 724 | 1241 | 0 | 11 | 2 | 9 | 82% |
| FY2014 | 5 | 9 | 554 | 696 | 1264 | 0 | 14 | 5 | 9 | 64% |
| FY2015 | 11 | 4 | 690 | 751 | 1456 | 2 | 15 | 3 | 12 | 80% |
| FY2016 | 6 | 9 | 580 | 697 | 1292 | 228 | 15 | 3 | 12 | 80% |

Runway incursion prevention systems (or surface safety systems) may be classified broadly as air traffic controller (ATC)-centric and aircraft (and ground vehicle)-centric systems. For example, in the U.S., ATC alerting systems include the Airport Surface Detection Equipment—Model X (ASDE-X) system and the Airport Surface Surveillance Capability (ASSC). However, these systems are installed only at the largest U.S. airports, with ASDE-X deployed at 35 airports and ASSC to be deployed at 9 additional airports. No plans exist to further deploy these systems. In contrast to ATC alerting systems, the FAA's Runway Status Lights (RWSL) system is intended for aircraft and ground-vehicle alerting. RWSL uses automatically controlled in-pavement lights to signal the pilot if it is unsafe to enter the runway. RWSL uses surveillance sources (such as ASDE-X or ASSC), light control logic, and a Field Lighting Subsystem (FLS) with arrays of in-pavement light fixtures. The FLS provides RWSL with two types of lights: Runway Entrance Lights (REL) and Takeoff Hold Lights (THL). Normally, the REL and THL lights are extinguished. REL illuminate red when it is unsafe to enter the runway. THL lights illuminate red when it is unsafe to begin departure. A pilot still requires a clearance from the controller to enter or cross a runway or begin a departure. Thus, RWSL provides an additional, independent layer of safety, but use of FLS adds greatly to the cost and complexity of RWSL. For example, a typical FLS may involve multiple power shelters, constant current airfield lighting circuits, and several hundred in-pavement light locations—each with fixture, addressable controller, and power transformer components installed. Maintenance is a significant expense over the lifecycle of the system due to the harsh airport runway environment's effect on the FLS equipment. RWSL helps only 17 major U.S. airports, and technical problems and unexpected costs have significantly slowed further deployment of the in-pavement FLS. This leaves hundreds of other airports without the safety benefits of RWSL. Thus, a possible explanation for the rise in the runway incursion rate is that runway incursion safety systems are not widely installed at U.S. Airports—the data in Table 1 suggests that this is the case, with about 80 percent of the most severe runway incursions occurring at airports without an aircraft-centric alerting system.

To overcome deficiencies with current ATC-centric and aircraft-centric runway incursion prevention systems, including limited deployment of current systems, disclosed herein is an advisor system that includes a receiver, installed on a moving first platform, that receives one or more signals from a signal source installed on a moving second platform, the signals conforming to one or more types of surveillance signals; a processor, coupled to the receiver, that processes a given signal of a given signal type to produce signal data; and a non-transitory computer-readable storage medium having encoded thereon a program of instructions. A processor executes the instructions to determine a first path vector for the moving first platform, determine a quality factor associated with the given signal, and based on the qualify factor, analyze the signal data from the given signal to identify a threat to the moving first platform. To analyze the threat, the processor determines a second path vector for the moving second platform; identifies the second path vector within a minimum proximity value of the first path vector; and provides an advisory to the moving first platform.

In an aspect, the advisor system is a runway advisor system that makes runway incursion avoidance possible at any airport for any aircraft. As an aircraft-based, or aircraft-centric advisory system, the runway advisor system is designed to advise pilots in aircraft in the movement area of an airport (e.g., on the runway surface), and provides an advisory to the aircraft's pilot and other cockpit crew when the runway advisor system computes a potentially unsafe runway condition (i.e., another aircraft that is projected to occupy the runway intersection-being-approached within system parameterized thresholds). In an aspect, the runway advisor system may combine Runway Status Lights (RWSL) alert concepts in algorithms for identifying unsafe runway entrance; to increase runway safety without the need for investing in airport infrastructure.

In an aspect, the runway advisor system may be implemented as a Mobile Runway Advisor (MoRA) system, and for ease of description, the term MoRA generally will be used henceforth, although those skilled in the art will understand that the concepts disclosed with respect to the MoRA system may apply equally to other implementations of the Runway Advisor system. In an aspect, the MoRA system may leverage existing Electronic Flight Bag (EFB) systems.

In an aspect, the MoRA systems includes a non-transitory, computer-readable storage medium having encoded thereon a program of instructions that when executed by a processor causes the processor to determine a current state of a first aircraft, operating on a movement area of an airport, including determining a path vector for the first aircraft, the path vector including aircraft position, acceleration, speed, and direction of travel of the first aircraft (note that the first aircraft may be stopped, in which case, the path vector may include aircraft location and possibly the direction the first aircraft is pointed) on the movement area; process a surveillance signal transmitted from a second aircraft (or base station if present at the airport) operating on the movement area to determine a possible interference of the first aircraft by the second aircraft including determining a quality of the surveillance signal, based on the quality determination, determining a movement vector of the second aircraft (note that the second aircraft may be on a landing approach of may be on the runway surface), and comparing the path vector and the movement vector to identify the possible interference; and providing an advisory at the first aircraft based on the compared path vector and the movement vector.

In an embodiment, the MoRA system uses a decentralized aircraft-centric approach that does not require a physical lighting system or an airport surface surveillance system. Instead, the MoRA system uses as an input, the location of other aircraft in the vicinity. One possible source of this aircraft information is the soon to be universally-deployed ADS-B, which is due by 2020. To use ADS-B In in this embodiment of the MoRA system, aircraft may be equipped with an ADS-B In receiver. Using ADS-B In, this embodiment of the MoRA system processes and maintains sequences of position reports from nearby aircraft. Other embodiments of the MoRA system may use ADS-B Out information without ADS-B In information. Still other embodiments of the MoRA system may use surveillance system data other than ADS-B Out data.

In an embodiment, the MoRA system includes a safety logic system that uses ownship position, an airport runway model, and tracks of other aircraft and vehicles to determine runway status at runway intersections. The safety logic system allows the MoRA system to generate an advisory when a runway intersection that an aircraft is approaching is unsafe to enter. The advisory provides the pilot and other members of the cockpit crew with an opportunity to reassess the situation before entering the runway intersection. Only other aircraft/vehicle tracks or trajectories predicted or projected to enter the runway intersection of interest within a time threshold may be relevant. Tracks on the runway moving below a configurable speed or acceleration threshold may be ignored. Unlike the challenge faced by the RWSL system to determine states for numerous REL and THL arrays, the MoRA system determines the state for the runway intersection being approached by ownship. If a false advisory is generated or if the advisory stays active for a few seconds longer than may be necessary, there is no impact on safety and only a minor delay in surface movement.

The MoRA system may incorporate a health monitoring system that ensures the MoRA system performs with sufficient accuracy and minimal latency. The health monitoring system verifies the quality of surveillance and detects reductions in available system resources that could affect the accuracy of the advisory service. When the health monitoring system indicates a reliable operational state, the MoRA system provides a system "online" indicator that is displayed in the cockpit. If the advisory cannot be provided reliably, the MoRA system may suppress the advisory and instead may display a system "offline" indication. The health monitoring system minimizes the chance for a false or late advisory that might delay safe aircraft movements or lower the pilot's confidence in the advisory.

In an embodiment, the MoRA system advisory, indicating that it is unsafe to enter the runway, may be displayed on an EFB. The advisory may be, but does not need to be, shown on a digital moving map of the airport indicating ownship position and the position of the other aircraft and/or vehicles. In an embodiment, the MoRA system is integrated with aircraft's existing display equipment to ensure the advisory is displayed prominently. However, integrating a new capability like the MoRA system into existing avionics and cockpit displays may be a long and costly process. This integration is further complicated by the breadth of aircraft and avionics suites that would require retrofitting. Since the MoRA system provides an advisory, which is not a safety critical message, the MoRA system could be used on an EFB.

FIG. 1B(1) illustrates an airport environment in which a MoRA system, as disclosed herein, may be employed to reduce the danger of runway incursion and possible collision. In FIG. 1B(1), airport environment 10 includes terminal 11 with control tower 12, ramp area 13, taxiways 14A and 14B, taxiways 15A and 15B, and runways 16A and 16B, which intersect with taxiways 15A and 15B at intersections 17A and 17B, respectively. Airplanes 18A and 19A can be seen approaching intersection 17B, with airplane 18A on runway 16A and airplane 19A on taxiway 15B. The tower 12 supports airport surface detection equipment (ASDE) 12A.

The airport environment 10 also may include various airport safety systems and aircraft tracking systems including runway entry light (REL) arrays REL-A, -B, and -C, and take off hold light (THL) arrays THL-A and THL-B. THL array THL-A and REL arrays REL-A, -B, and -C are illuminated. Other REL arrays are located on taxiways leading to runway and 16B. Note that there are no REL arrays to warn against entry onto runway 16A from taxiways 14A and 14B but entry at these intersections would be protected with MoRA advisor service. Also installed in the airport environment 10 are surveillance systems including multilateration (MLAT) system 21 with receivers/transceivers 21A, 21B, and 21C, and airport surveillance radar (ASR) 22. The MLAT system 21 may be, or may incorporate ADS-B signaling, and thus may receive ADS-B signals from aircraft operating in the runway environment 10. The MLAT system 21 may combine the received ADS-B signals with surveillance from other sources, and then broadcast a combination of that surveillance picture in another signal over ADS-B. This signal is referred to as the TIS-B service (Traffic Information Service-Broadcast). The TIS-B signal may include aircraft that are not transmitting ADS-B information and so can fill in what might be missing from the peer-to-peer signals.

As can be seen in FIG. 1B(1), the THL array THL-B is not on, meaning airplane 18A on runway 16A may continue its departure rollout during takeoff. The REL array REL-A on taxiway 15B is on, meaning it is unsafe for airplane 19A to enter intersection 17B. In addition to airplane 18A on runway 16A and airplane 19A on taxiway 15B (and held by REL array REL-A), airplane 19B is on taxiway 14A with no REL array lit; airplane 19C is on taxiway 14C with REL array REL-C lit; airplane 19D is on taxiway 14B with no REL array lit, and airplane 18B is on runway 16A with THL array THL-A lit.

FIG. 1B(2) illustrates alternate airport environment 10', which may be representative of many smaller airports. The airport environment 10' does not include several of the safety features, such as takeoff hold lights and runway entry lights, multilateration systems, and ground radar systems, for example. In the environment 10', the herein disclosed MoRA system may provide the sole automation system for advising pilots against unsafe runway entrance. As shown in FIG. 1B(2), airplane 19A' is stopped at intersection 17A' and airplane 19B' is on hold at intersection 17B' because of airplane 18A' on a landing approach to runway 16A'. MoRA systems installed on each of airplanes 19A' and 19B' receive signals from airplane 18A' and the MoRA systems may generate an advisory signal and message to alert the pilots of airplanes 19A' and 19B' that entry onto runway 16A' is not safe.

FIG. 1C is a block diagram that illustrates an example mobile runway advisory (MoRA) system. In FIG. 1C, MoRA system 25 is implemented on airplanes 18A and 19A of FIG. 1B(1). The MoRA system 25 includes front end 26, advisory system 27, and output 28. The MoRA system 25 may be part of a fixed or installed aircraft system. Alternately, the system 25 or components of the system 25 may be portable. For example, the system 25 or components of the system 25 may be implemented in an Electronic Flight Bag (EFB).

The front end 26 receives and processes an input surveillance signal IS. The signal IS may be an analog signal (IS-A) or a digital signal (IS-D). The signal IS may be supplied by a surface search radar system such as the system 22, in which case the signal IS may be an analog signal (IS-A), or a digital signal (IS-D), depending on signal processing executed at the surface search radar system 22. The signal IS may be a digital signal provided by multilateration system 21. In addition to surface search radar and multilateration systems 21 and 22, respectively, the signal IS may be provided by suitably equipped aircraft. For example, both airplanes 18A and 19A may be configured to broadcast digital signals (IS-BD) that may be received by each other. More specifically, airplane 18A receives signal IS-BD(19) from airplane 19A, and airplane 19A receives signal IS-BD (18) from airplane 18A. In an aspect, the signals IS-BD(18) and IS-BD(19) are digital signals that follow a prescribed format and that convey sufficient information to the receiving airplane to allow the receiving airplane to at least track movement of the sending airplane.

The front end 26 may include hardware and software components. The front end 26 may be at least partly implemented as a software defined radio (SDR). An SDR provides low-cost reconfigurable processing of an incoming digital or analog signal. The SDR allows for reception and processing of a wide range of radio frequency (RF) signals. The SDR allows the system 25 to process an analog RF signal across a wide range of frequencies, down convert the received RF signal, digitize and then time-stamp the digitized signal and send the time-stamped signal to the advisory system 27. The SDR also may receive a wider range of digital RF signals and prepare the received digital RF signals for processing in advisory system 27. The front end 26 may include its own receive antenna (antenna 26A) or the front end 26 may be coupled to one or more installed aircraft receive antennas (not shown).

In an alternative embodiment of the system 25, all or most of the functions of the front end 26 may be accomplished by installed or existing systems or components of the airplanes 18A and 19A, and in this alternative embodiment, the system 25 may receive signals information that is ready for processing in the advisory system 27.

The advisory system 27 executes various processes, routines, and algorithms to determine if a runway collision involving, for example, airplanes 18A and 19A is possible based on computed tracks of the two aircraft. The advisory system 27 may incorporate a health monitoring system that, among other functions, determines if a signal received at the front end 26 is of sufficient quality so that the advisory system 27 may produce a reliable and accurate advisory. Operation of a system like the advisory system 27 is described in more detail with respect to FIGS. 2A-2E.

The output 28 provides one or more of visual and audio displays to aircraft cockpit crew based on receipt of an advisory from the advisory system 27. Some functions and components of the output 28 may be implemented in existing aircraft systems or components. Alternately, some functions and components of the output 28 may be implemented in an EFB.

Figure 1D:
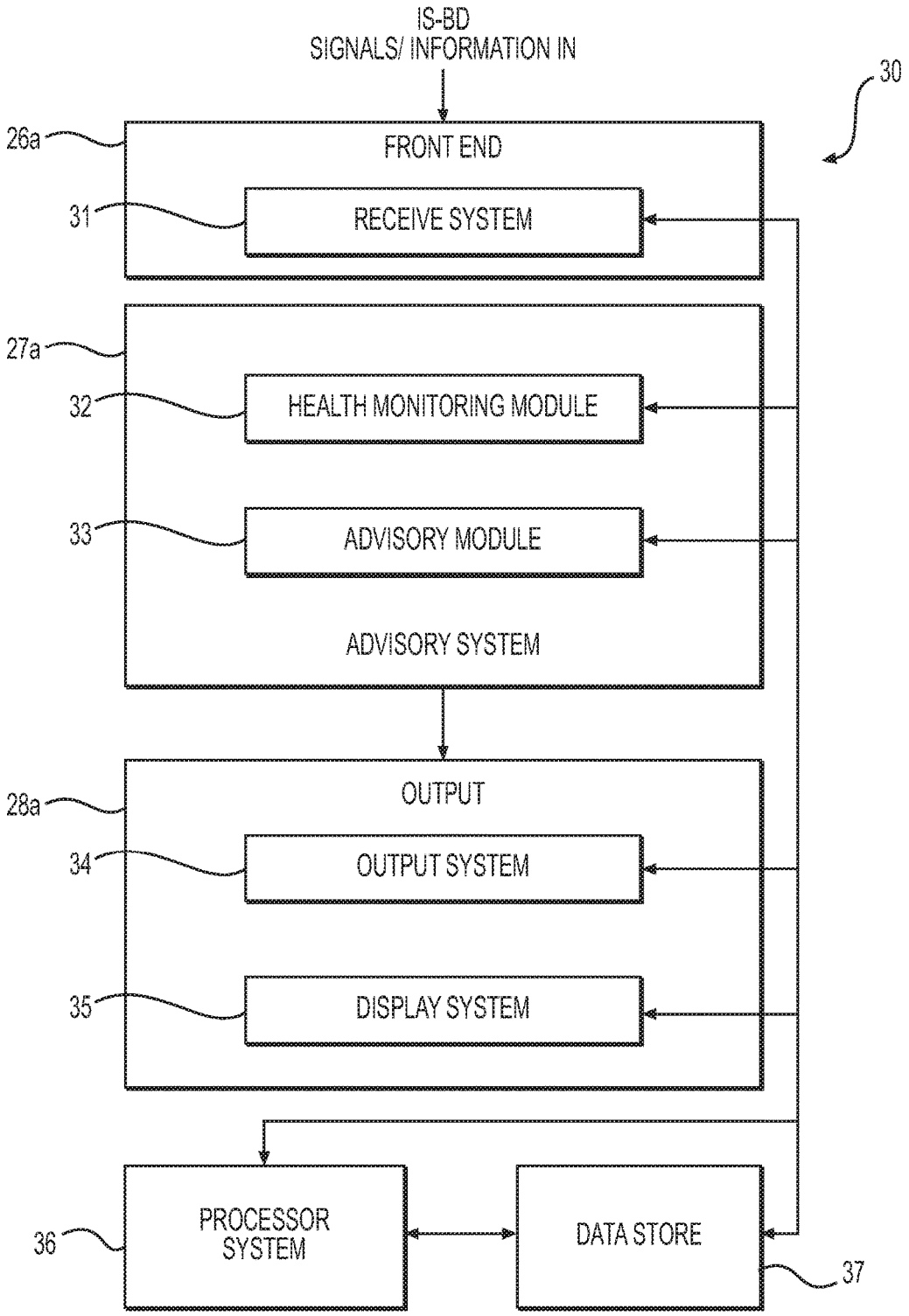
FIGS. 1D-1F illustrate aspects of the example mobile runway advisory system of FIG. 1C.

FIG. 1D is a block diagram of an example implementation of the system 25 of FIG. 1C. In FIG. 1D, MoRA system 30 receives digital broadcast input signals (IS-BD) from aircraft operating (moving or stationary) on runways and other movement areas of the airport environment 10. The system 30 also receives IS-BD signals from ground vehicles. In addition, the system 30 may receive other signals, including GPS signals from an onboard GPS antenna. As an alternative to receiving GPS signals, the system may receive ownship position data from an existing ownship GPS system (i.e., a GNSS). The signals IS-BD are received at front end 26*a*, and more specifically at receive system 31. The receive system 31 (shown in detail in FIG. 1E) communicates with advisory system 27*a*, and more specifically with health monitoring module 32 and advisory module 33. Within the advisory system 27*a*, the health monitoring module 32 provides inputs to the advisory module 33. The advisory module 33 provides inputs to output system 34, which in turn provides inputs to display system 35. Finally, included in the MoRA system 30 are processor system 36 and non-transitory, computer-readable data store 37. The processor system 36 is shown in detail in FIG. 1F and includes a central processor unit (CPU) or other computing platform 36*a*, memory 36*b*, input/output 36*c*, (human) user interface 36*d*, and a data and communication bus 36*e* coupling the other processor system 36 components. Software components of the system 30 may be provided and stored in the data store 37, accessed by the computing platform 36*a* over bus 36*e*, and stored in memory 36*b* for execution by the computing platform 36*a*. In an embodiment, MoRA system 30 is implemented on a tablet or similar mobile device. MoRA system may be implemented as, or as part of, an EFB.

Figure 1E:
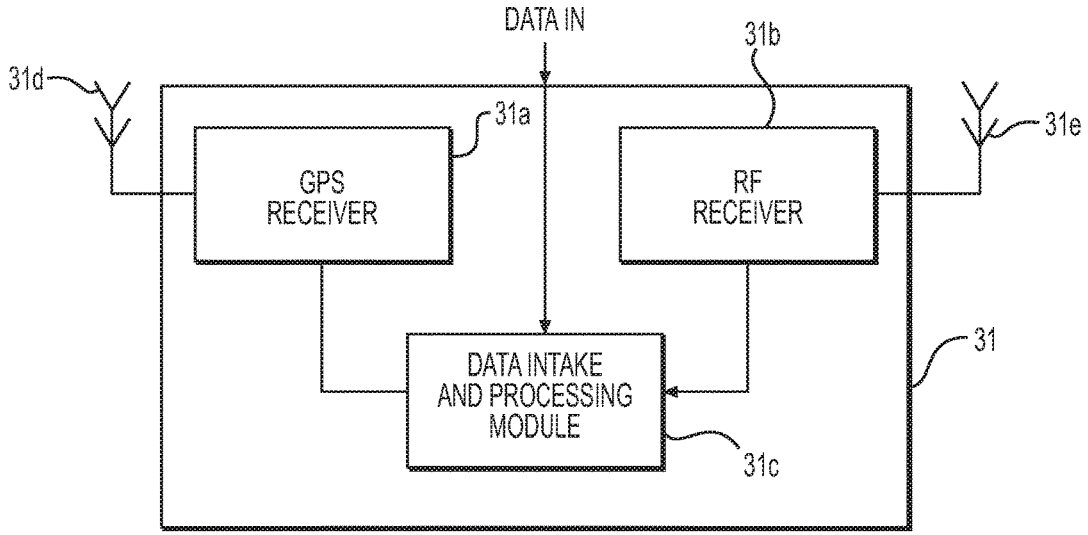
Figure 1F:
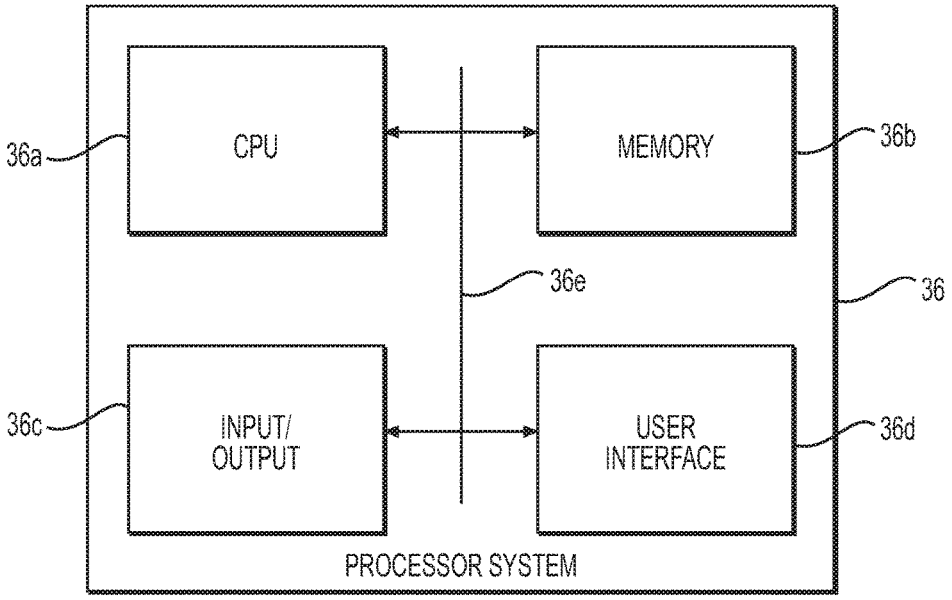

Referring to FIG. 1E, receive system 31 may be implemented as a software defined radio (SDR), and may include hardware and software components. Use of an SDR allows reconfiguration of the receive system 31 to accommodate changing technologies, changing input surveillance systems, and other changes to the MoRA 30. In an embodiment, the receive system 31 may include a GPS receiver 31*a* and a RF receiver 31*b*. The GPS receiver 31*a* and the RF receiver 31*b* are coupled to onboard antenna (not shown). As an alternative to GPS and RF receivers, the receive system 31 may receive information from onboard GPS and RF systems. When RF signals are to be received at the receive system 31, the receive system 31 may include analog components to convert the RF signals to appropriate digital signals. In an embodiment, the MoRA system 30 is intended to receive and process signals broadcast by aircraft on approach to land at the airport, by aircraft while on the ground, and more specifically in airport movement areas, signals broadcast by ground vehicles operating in the movement areas, and by optional ADS-B base stations if present.

Health monitoring module 32 receives the input IS-BD signals and determines if signal quality is sufficient to allow the advisory module 33 to provide a reliable and accurate advisory. Health monitoring module 32 also monitors other subsystems such as utilization of CPU 36A or free memory in Memory 36B, to see if the health of internal subsystems and modules are sufficient to allow the advisory module 33 to provide a reliable and accurate advisory. If signal quality or internal health are not sufficient, the system 32 may provide an offline signal or possibly an alert to cockpit flight crew; if signal quality is sufficient, the system 32 may provide an online signal to cockpit flight crew. The alert and the online signal may be provided in the form of a light—e.g., an alert (offline) red light 121E and an online green light 121D—see FIG. 3E. In addition, if signal quality is not sufficient, the system 32 may provide an instruction to the advisory module 33 to prevent the advisory module 33 from generating an advisory.

The advisory module 33 may receive ownship position data, ownship speed data, and ownship heading data. In an embodiment, these data may be provided from a GPS receiver in the receive system 31. In another embodiment, these data may be provided by an ownship GPS that is external to the system 30. The advisory module 33 also receives an IS-BD signal from other aircraft and from ground vehicles operating in the runway movement area. Finally, the advisory module 33 receives a map of the runway movement areas (the maps for all airports may be stored in the data store 37). The advisory module 33 includes instructions that, when executed by the processor system 36, allow the system 30 to generate tracks for all aircraft and ground vehicles for which position and movement data are available; the instructions also allow the system 30 to generate tracks for ownship. In an embodiment, the advisory module 33 instructions are executed to provide tracks only for aircraft and ground vehicles that are within a specified time of an intersection between a runway and a taxiway being approached by ownship. If the ownship computed track shows an approaching intersection or a position and heading indicative of intent to enter an intersection from a taxi or stopped state; and any other computed tracks projected into the intersection within a specified time or other criteria showing significant probability of hazard, the advisory module 33 will generate an advisory signal.

Output system 34 receives an advisory signal from advisory module 33 and generates one or more advisories based on the display capabilities of the display system 35. For example, the display system 35 may be able to display a moving map of the airport environment 10 and the output system 34 may generate an advisory that shows a portion of the moving map with other aircraft projected tracks using the runway prior to an intersection being approached by ownship. The moving map may display the hold lines relative to an intersection for the benefit of ownship pilot's situational awareness.

Display system 35 receives advisories from output system 34. Display system 35 provides display features that may include a display screen, lights, speakers, and a heads-up display, for example. When the system 30 is implemented on a tablet, for example, the display system 35 may include the tablet's display screen and the tablet's speaker system.

As noted herein, the FAA has mandated incorporation of ADS-B Out systems in aircraft by 2020. The FAA has not mandated incorporation of ADS-B In systems. Embodiments of a MoRA system as disclosed herein may use data broadcast from ADS-B Out equipped aircraft and vehicles and ADS-B base stations. In addition, aircraft equipped with ADS-B In may use the data received by ADS-B In systems as an input to the herein disclosed MoRA system embodiments.

Figure 2A:
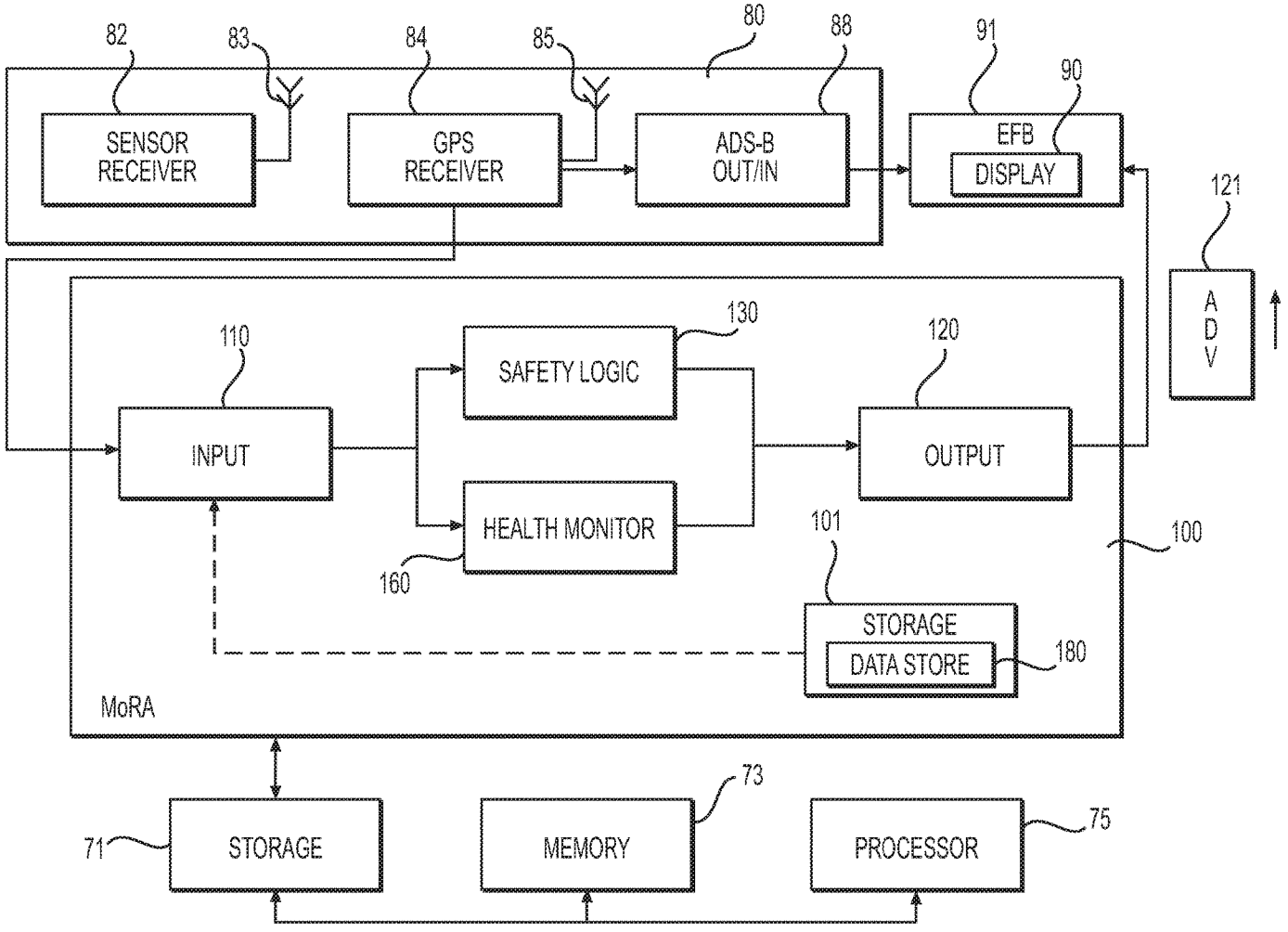
FIG. 2A is a block diagram that illustrates another example mobile runway advisory system of FIG. 1C.

FIG. 2A is an overall diagram of an example MoRA system 100 that may be installed on each of the airplanes 18A and 19A (and the other airplanes) of FIG. 1A. Considering airplane 18A as representative, in FIG. 2A, airplane 18A includes MoRA system 100, which in turn includes input 110, output 120, safety logic system 130, and health monitoring system 160. Note that airplane 19A may have a similar or the same MoRA system. The disclosure that follows discusses the MoRA system 100 from the perspective of airplane 18A; i.e., what advisories ultimately are provided in the cockpit of airplane 18A. However, the MoRA system onboard airplane 19A (and the other airplanes) may generate and display similar advisories.

The MoRA system 100 may be stored on non-transitory computer-readable storage medium 71, may be loaded on to memory 73, and may be executed by processor 75. The hardware components 71, 73, and 75 may be installed airplane components, or may be components of a larger MoRA plug-in or components of an Electronic Flight Bag (EFB). Alternately, the MoRA system 100 may be provided as a standalone non-transitory computer-readable storage medium, such as storage medium 101. The MoRA system 100 also may include dedicated data store 180 in which may be stored ownship data, airport maps, and other data related to preventing runway incursions. Alternately, the data related to preventing runway incursions may be stored on other data storage components of the airplane 18A such as storage medium 101. Input 110 receives and processes signals from surveillance system 80 and output system 120 provides an output to display system 90. The input system 110 provides components that can receive and process a variety of surveillance signals. ADS-B is a surveillance technique that relies on aircraft or airport vehicles broadcasting their identity, position and other information derived from on board systems (e.g., a GNSS, etc.). This signal (ADS-B Out) can be captured for surveillance purposes on the ground (ADS-B Out) or on board other aircraft to facilitate airborne traffic situational awareness spacing, separation and self-separation (ADS-B In). The ADS-B data transmitted are defined in the relevant standards and certification documents (e.g. EASA AMC 20-24 for ADS-B in Non-Radar Airspace or CS-ACNS for "ADS-B out"). The ADS-B data include aircraft horizontal position (latitude/longitude), aircraft barometric altitude, various quality indicators, and an aircraft identification including a unique 24-bit aircraft address.

In an embodiment, the surveillance system 80 incorporates ADS-B In processing components and the input system 110 receives corresponding signals from the ADS-B processing components. In addition to, or in lieu of ADS-B signaling, the input system 110 may receive information from a surface radar surveillance system such as the system 22 of FIG. 1B(1), a multilateration system such as the multilateration system 21, and a traffic collision avoidance system (TCAS), although currently, and TCAS are used for aircraft that are airborne. The output system 120 provides an advisory 121 for display on display system 90. In an embodiment, the display system 90 is, or is part of, Electronic Flight Bag 91. Alternately, the display system 90 may be a component of the airplane's installed display systems. For example, the display system 90 may be a generic cockpit display of traffic information (CDTI). In an aspect, the advisory 121 includes one or more of a text message 121A, a visual signal (e.g., a warning light) 121B, an audio signal 121C, and a moving map 121D of the specific runway layout for the airport environment 10 (see FIG. 3E).

Figure 2B:
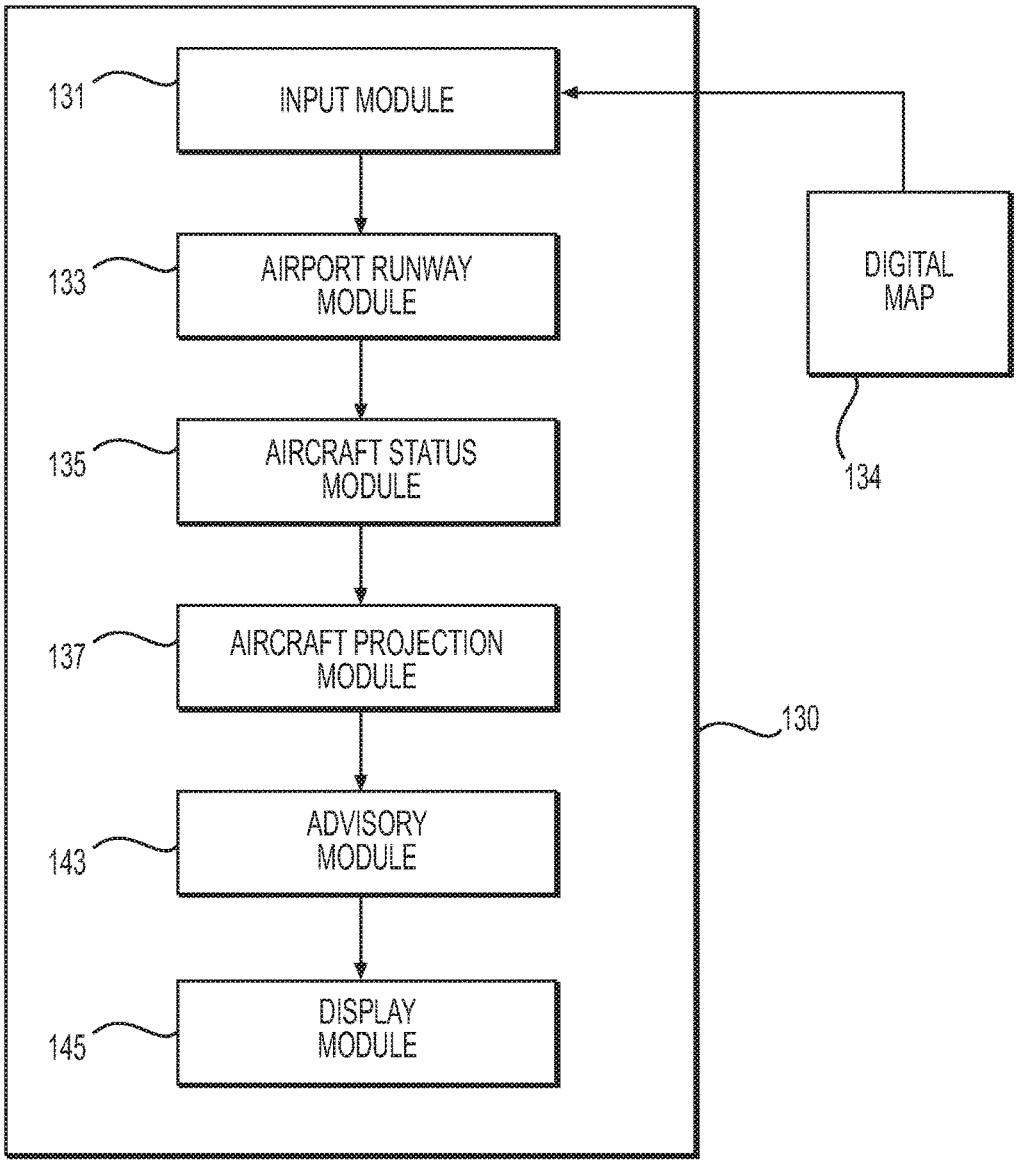
FIGS. 2B-2C illustrate components of the example mobile runway alert system of FIG. 2A.

FIG. 2B is a block diagram of an example safety logic system 130. In FIG. 2B, safety logic system 130 includes input module 131, airport runway module 133, aircraft status module 135, aircraft projection module 137, advisory module 143, and display module 145. The input module 131 receives as inputs, signals, information, and data from systems and components external to the MoRA system 100. The inputs include ownship position and status (which may include multiple ownship position signals, including a GPS position signal (latitude and longitude) from an on-board GPS receiver), and, in an embodiment, ownship speed and heading (also from the GPS receiver or other onboard sensor/processor). As an alternative, the ownship speed and heading information may be generated by components of the safety logic system 130 based on GPS position updates. Further, the inputs may include ownship acceleration, which may be computed from ownship speed by a processor external to the safety logic system 130. Alternately, the safety logic system 130 may compute ownship acceleration. The input logic 131 may receive a digital map (or map updates) of the airport environment 10, and more specifically, a digital map of the airport's runway system, including gate areas, aprons, ramps, taxiways, runways, and intersections.

Airport runway module 133 may receive a digital map 134 of the airport's runway system from the input logic 110. Alternately, the map 134 of the airport's runway system may be stored internally (e.g., in data store 180) within the MoRA system 100, although the stored map may receive updates when and where appropriate. When stored in data store 180, map updates may be provided through input logic 131.

Aircraft status module 135 uses inputs from the input module 131 and inputs from components internal to the MoRA system 100 to compute ownship status and status for certain other aircraft (including, e.g., airplane 19A) operating on the surface of the runway environment 10. For example, the aircraft status logic 135 may either receive, or compute, aircraft speed, acceleration, and heading for ownship and for certain other aircraft, including airplane 19A. The aircraft status module 135 may receive ownship position and the position of airplane 19A. The aircraft status module 135 may plot and show the position of ownship (airplane 18A) and airplane 19A on the moving map 134, which then may be displayed to cockpit personnel, as described herein.

Aircraft projection module 137 receives inputs from the aircraft status logic 135 and the airport runway module 133 to project tracks for ownship (airplane 19A) and airplane 18A on the moving map 134 as the airplanes 18A and 19A approach runway intersection 17B. For example, airplane 18A may be at a position relative to intersection 17B and may be accelerating and moving at a speed that will carry airplane 18A into intersection 17B. Airplane 19A is stopped on taxiway 15B at a hold line. The aircraft projection module 137 projects airplane 18A into intersection 17B, thus satisfying criteria for the advisory module 143 to produce a signal that indicates to the pilot of airplane 19A that it is unsafe to proceed into intersection 17B. The signal from the advisory module 143 may continue until airplane 18A no longer is projected into intersection 17B, either because airplane 18A has passed through the intersection 17B, has turned, or has slowed.

Thus, the module 137 is executed to compute when a runway intersection is unsafe to enter due to possible collision with another aircraft using the runway and projected to pass through the intersection with minimum speed. An airplane approaching the runway may stop at a hold line and from a physical point of view the airplane's track has no speed and so is not projecting to move. The module 137 executes to use knowledge of airplane position and heading on the surface model to determine that the intersection in front of the airplane is an intersection of interest for which a runway entrance advisory may be appropriate; however, whether the runway entrance advisory is generated requires knowledge of the state vectors of other airplanes that may to project into the intersection along the runway.

Advisory module 143 receives inputs from the aircraft projection module 137 and generates a runway entrance advisory signal to the pilot using the taxiway and approaching the runway intersection or stopped near the hold line (as determined with help from airport runway module 133) if the inputs show another aircraft projected to cross the intersection using the runway digital map 134. In an embodiment of MoRA, the advisory module 143 may generate an unsafe to enter the runway signal. The onboard hardware may be an EFB, which may be implemented as a tablet or laptop computer, for example.

Display module 145 provides one or more advisories as generated by the advisory module 143 to the output system 120. In an embodiment, the advisories (see FIG. 3E) include a text message 121A, a visual signal (e.g., a warning light) 121B, an audio signal 121C, and a moving map 121D of the specific runway layout for the airport environment 10. Which specific advisories are provided to the output logic may depend on the capabilities of the display hardware. For example, if the display hardware is a tablet, the advisories may include only the text message 121A and the moving map 121D. The display module 145 determines which of the advisories to send to the output system depending on the connected display device.

Figure 2C:
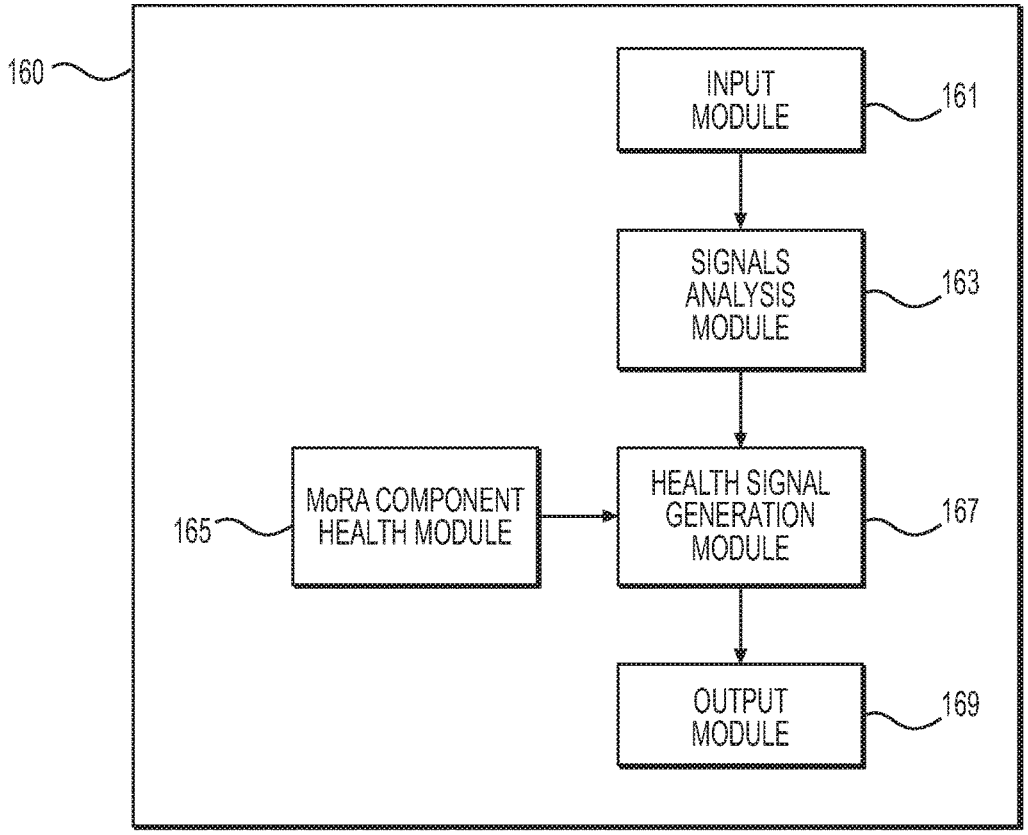

FIG. 2C is a block diagram of an example health monitoring system 160. The health monitoring system 160 executes to assess the quality of MoRA communications signals, the quality of the surveillance signal derived from the communications signal, and the quality of the MoRA processing itself. If any of these quality determinations is unsatisfactory, the MoRA system 100 may "take itself offline." For example, if a threshold for processor utilization rate exceeds a threshold value, the MoRA system 100 may take itself offline. Similarly, the system 160 may monitor internal memory utilization to see if that internal resource is below a threshold such that the quality of the MoRA output (i.e., and advisory signal) could be compromised. Any monitorable factor that could lead to degraded service is in scope of the system 160. Thus, the system 160 ensures that the MoRA system 100 performs with sufficient accuracy and minimal latency. The system 160 verifies the quality of surveillance and detects reductions in available system resources that could affect the accuracy of the advisory signal. When the system 160 indicates a reliable operational state, the MoRA system 100 displays a system "online" indicator in the cockpit. If an advisory signal cannot be provided with sufficient quality, the advisory signal may be suppressed and a system "offline" indication or another alert may be displayed to the pilot instead. The system 160 minimizes the chance for false or late advisory signals that might delay safe aircraft movements or lower the pilot's confidence in the advisory signal.

In FIG. 2C, health monitoring system 160 is seen to include input module 161, signals analysis module 163, MoRA health module 165, health signal generation module 167, and output logic 169. The input logic 161 receives surveillance signals from a signal source (e.g., ADS-B, a surface surveillance radar, a multilateration system), identifies the signals and their source, and may perform preprocessing steps to provide the proper signals information for use by the signals analysis module 163.

The signals analysis module 163 receives the processed signals information and determines if the signals possess the requisite qualities to allow the safety module 130 to accurately (i.e., within a threshold accuracy value) generate advisories. The signals analysis module 163 may provide a binary output—either the signal quality is satisfactory, or it is not. Alternately, the signals analysis module 163 may provide a more nuanced output; for example, the signals analysis module 163 may classify the signals as unsatisfactory, marginal, good, and excellent, or may provide a percentage score for the signals, from zero percent to 100 percent.

As noted herein, ADS-B may provide a surveillance signal useable by the MoRA system 100. An ADS-B Out signal may be sent once per second. The quality of an ADS-B signal may, in some scenarios, be affected by various error sources including environmental factors. Such error sources could degrade the integrity of the signal received at the input 110 enough to prevent the digital data in the signal from being decoded without errors. Furthermore, the ADS-B signal may include error detection codes that the MoRA system 100, and the health monitoring system 160, may use to identify a low-quality signal.

The health signal generation module 167 receives an indication of signal health from the signal analysis module 163, and determines if the signal health indication is sufficiently reliable to use the signal received at the input 110 in generating a runway incursion advisory. If the signal is determined to be sufficiently reliable, the logic 167 sends an instruction to the output module 169. The output module 169 executes to (1) provide a system online light for display in the cockpit, and (2) provide an input to the safety logic 130, which the safety logic 130 uses to generate a runway incursion advisory.

The health monitoring system 160 also includes MoRA component health module 165. The module 165 may execute during start-up of the MoRA system 100, and periodically thereafter. The module 165 may execute to test the capabilities and operational status of various components of the MoRA system 100. The module 165 may provide signals to the health signal generation module 167 to indicate all MoRA components are operational or that one or more MoRA components are faulty.

Figure 3A:
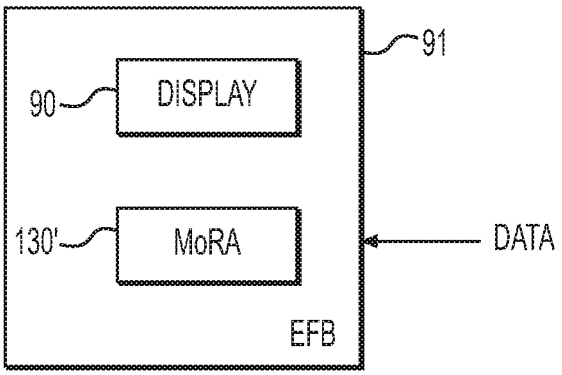
FIGS. 3A-3E illustrate alternate embodiments and aspects of a mobile runway advisor system.

FIGS. 3A-3E illustrate various embodiments of a runway advisor system, and specifically including a mobile runway advisor system. FIG. 3A illustrates a MoRA system implemented as a component 130' of EFB 91. The EFB 91 includes display 90, which may provide the online or offline alerts and the advisory 121 (see FIG. 3E).

Figure 3B:
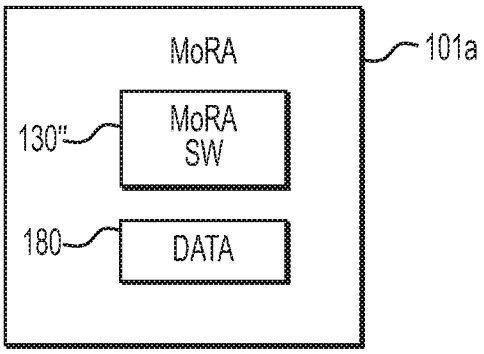

FIG. 3B illustrates a MoRA system stored as machine instructions 130" on non-transitory, computer-readable storage medium 101*a*. Also stored on storage medium 101*a* is data store 180, which includes data used in execution of the MoRA 100.

Figure 3C:
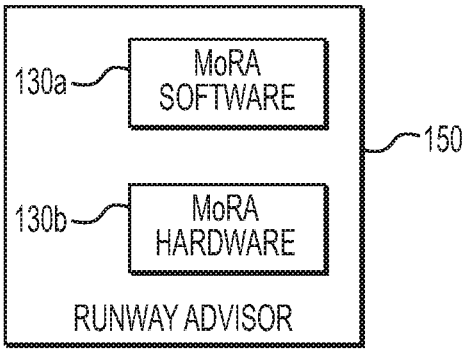

FIG. 3C illustrates runway advisor 150, which may be incorporated into the onboard systems of an aircraft (e.g., not a class 1 or 2 EFB); alternately, for a class 1 or 2 EFB, the runway advisor 150 may be incorporated into such an EFB. As can be seen in FIG. 3C, includes MoRA software 130*a* and hardware 130*b*.

Figure 3D:
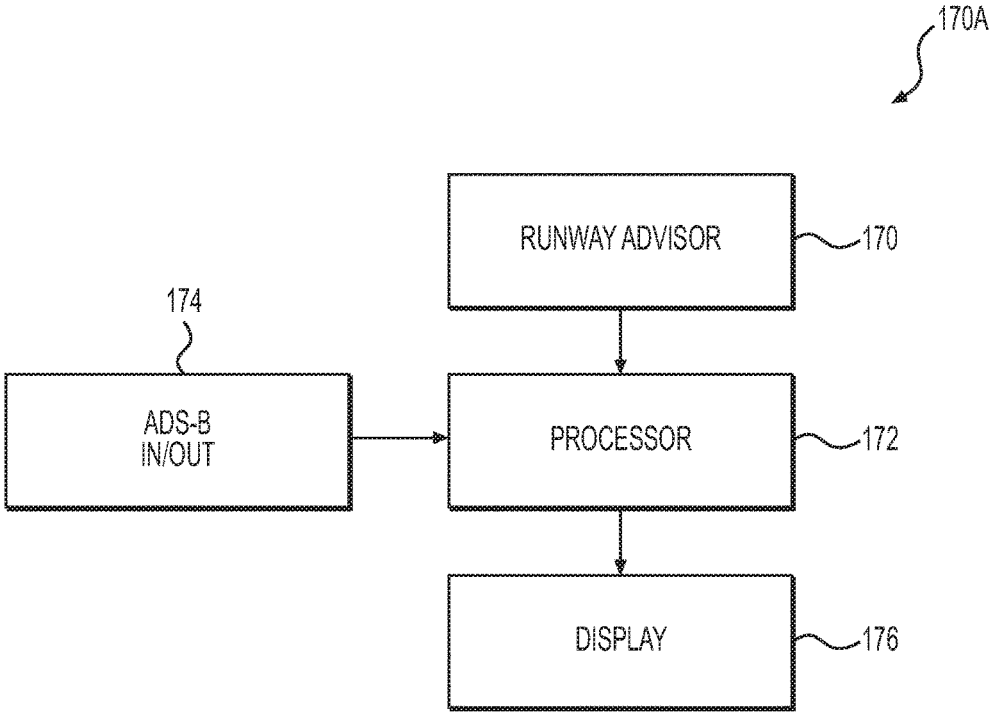

FIG. 3D illustrates advisor system 170A, which includes runway advisor 170, processor 172, ADS In/Out system 174 and display 176.

Figure 3E:
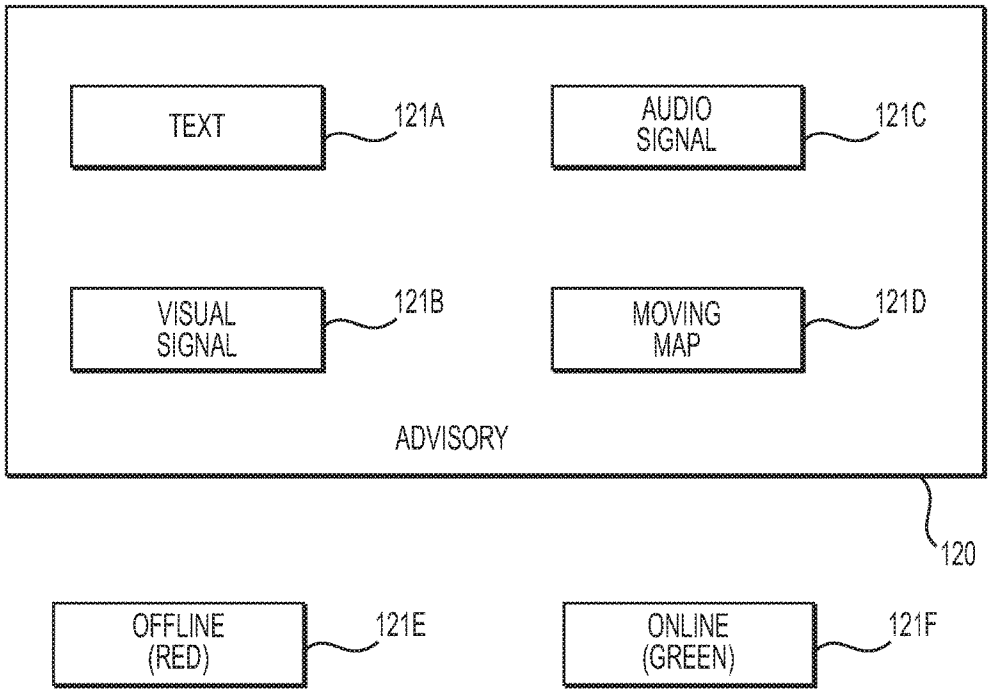

FIG. 3E illustrates outputs from a runway advisor system such as runway advisor system 170 of FIG. 3D or MoRA system 100 of FIG. 2A. The outputs include one or more of a text message 121A, a visual signal (e.g., a warning light) 121B, an audio signal 121C, and a moving map 121D of the specific runway layout for the airport environment 10. In addition, the MoRA system provides an off-line indicator 121E and an online indicator 121F.

FIGS. 4A-4D are flowcharts illustrating example processes executed through use of the MoRA system 100 of FIG. 2A. In general, the flowcharts illustrate a method that includes a receiver acquiring or accessing ownship data for a first aircraft operating on a movement area of an airport, a processor computing a path vector for the first aircraft based on the received ownship data, the processor analyzing a portion of the extracted ownship data to determine a quality of the signal, the processor receiving data extracted from a surveillance signal, the data comprising location data with extracted and/or determined velocity and acceleration vectors related to other aircraft, the processor analyzing a portion of the extracted data to determine a quality of the surveillance signals and if they are of sufficient quality to use. A processor executes instructions to analyze the data from the given signals to identify threats to the moving first platform. To analyze the threats, the processor applies algorithms to the data to determine projected interference between the first platform and the other platforms. Based on the results, the processor generates an advisory signal indicative of the projected interference to the moving first platform.

Figure 4A:
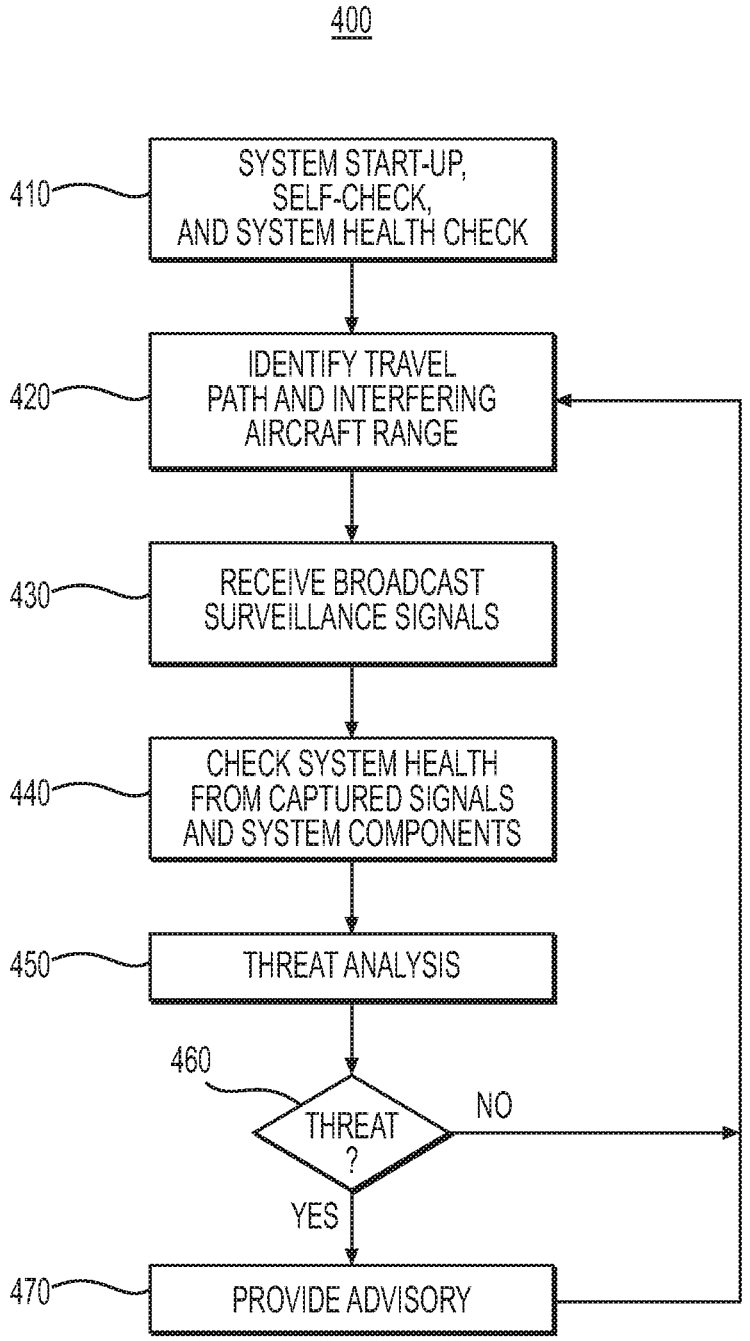
FIGS. 4A-4D are flowcharts illustrating example methods executed by the systems of FIGS. 1C-3E.
Figure 4B:
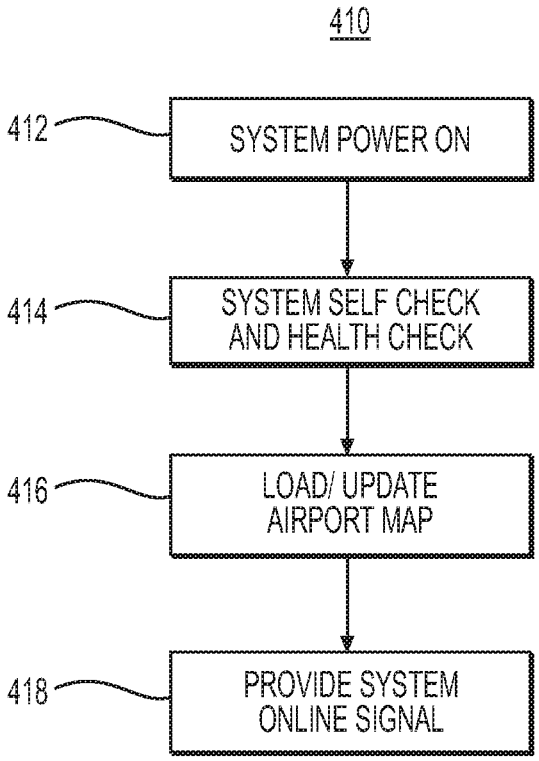

FIG. 4A is a flowchart illustrating example process 400 for overall operation of the MoRA system 100, which is implemented onboard a mobile platform, specifically on airplane 18A. In FIG. 4A, method 400 begins in block 410 in which the system 100 onboard airplane 18A is turned on and a start-up routine and internal self-check is executed by processor 75. The internal self-check may include, or be supplemented by, an internal health check, by execution of health monitor 160 (see FIG. 2A) in which components of the MoRA system 100 are checked for proper operation, as described herein. The system 100 then executes to load data related to the airport environment 10 (e.g., a digital moving map 134 and related data). The digital map 134 may be stored in data store 180. The processor 75 then may execute system 100 to verify the digital map 134 is up-to-date. For example, the system 100 may be executed to determine that the digital map 134 is the latest version. These specific routines are shown in FIG. 4B as blocks 412, 414, 416, and 418. Once the start-up routine and data loading operations of block 410 are complete, method 400 moves to block 420.

In block 420, processor 75 executes instructions of system 100 to identify a travel path of a second mobile platform, namely the airplane 19A, as it transits from gate area 13 in the East direction along taxiway 15B and approaching the hold line prior to the intersection with runway 16A. Execution of the processes of block 410 will identify the travel path including any runway intersections, such as runway intersection 17B, that the airplane 19A will enter between gate departure and becoming airborne (i.e., rotation point). The digital map 134 may display this path including intersection 17B. Travel paths are also identified including runway intersections of interest for aircraft after they land and enter the taxi movement state on their way to the gate area. Travel paths may be identified for mobile platforms, whether the mobile platforms are moving or stopped.

Figure 4C:
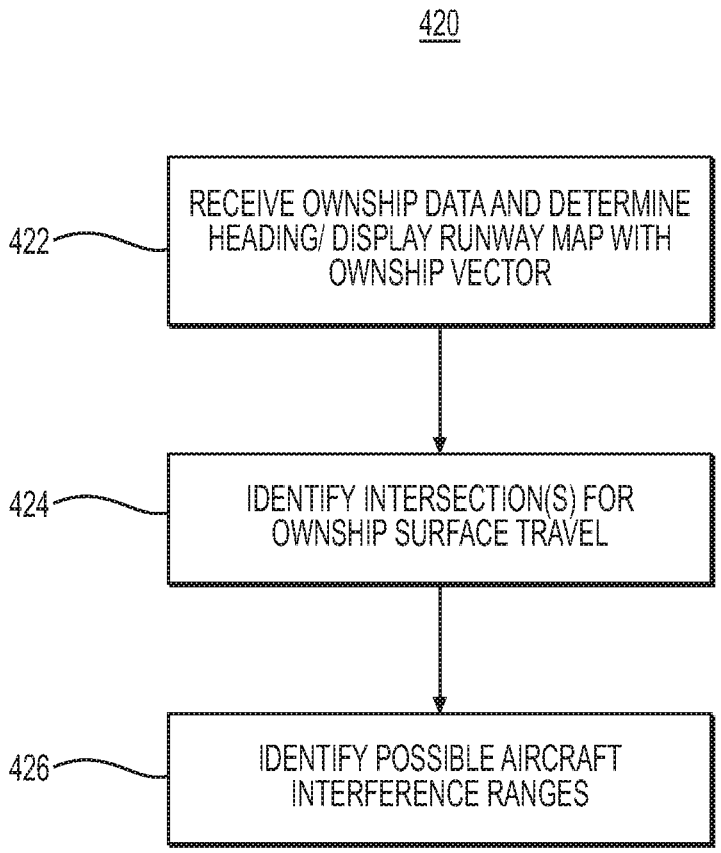

The processes of block 420 are shown in more detail in FIG. 4C. In FIG. 4C, block 422 the processor 75 executes instructions of the system 100 to receive ownship data, including ownship location over time to determine travel path. The processor 75 executes the instructions of block 422 to continually update ownship position on the digital map 134 and to display the digital map on a display in the cockpit of airplane 19A. In block 424, the processor 75 executes instructions of the system 100 to identify runway intersection 17B in the travel path of airplane 19A. In block 426, the processor 75 executes instructions of the system 100 to analyze the derived data from the received signals to identify threats to the moving first platform. The processor 75 may display projected position of airplane 19A as it taxis on the surface as an overlay to the digital map 134. Following block 426, method 400 moves to block 430.

Figure 1G:
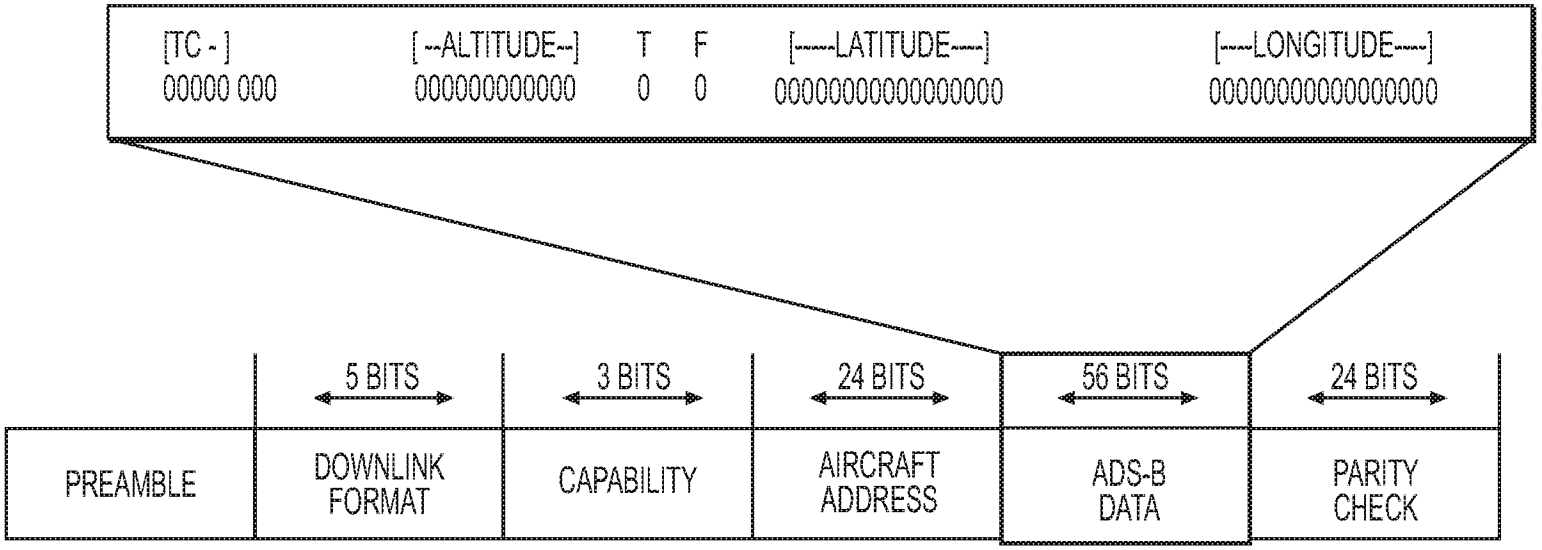
FIG. 1G illustrates an example of an Automatic Dependent Surveillance-Broadcast system (ADS-B) message.

In block 430, the processor 75 executes instructions of system 100 to process surveillance signals received onboard airplane 19A. For example, plane 18A and various ground vehicles may broadcast ADS-B Out signals (messages—see FIG. 1G) that are received at an antenna on airplane 19A. Each of the ADS-B Out messages may identify a particular aircraft or ground vehicle, and may include a latitude and longitude and other information for the aircraft or ground vehicle. The processor 75 may process the ADS-B Out messages to extract aircraft/vehicle position and to compute a travel vector. The processor 75 then may determine if an aircraft or vehicle may pose a threat to ownship or where ownship is projected to be within a certain time. Finally, the processor 75 may plot each of the other aircraft and ground vehicles on the digital map 134 when the positions and travel vectors of the other aircraft and ground vehicles may be relevant to the safety of ownship. Following block 430, the method 400 moves to block 440.

Figure 4D:
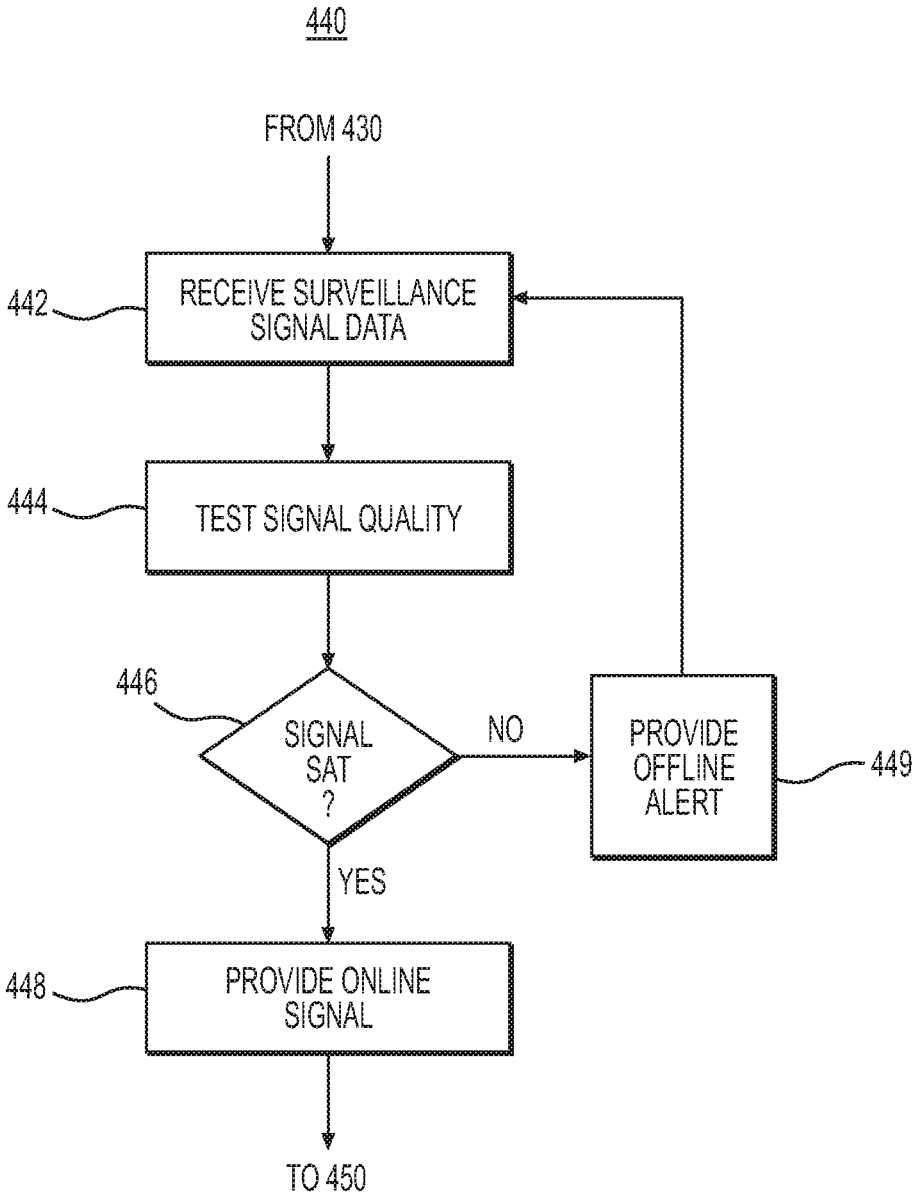

In block 440, the processor 75 executes instructions of the system 100 to monitor the health of the system 100, and specifically to determine if the surveillance signals received for processing by execution of system 100 are of sufficient quality to reliably and accurately determine if a potential safety hazard, such as an unsafe runway intersection, may occur along the travel path of airplane 19A, and to determine if components of the system 100 are functioning properly. Certain of the processes of block 440 are shown in more detail in FIG. 4D. In FIG. 4D, block 442, the ADS-B signal data are received and at block 444, the processor 75 executes instructions to test the quality of the communication containing the received surveillance signal and the quality of the surveillance itself. For example, the processes of block 444 may include a check of the parity bits of the ADS-B message, may determine the latitude and longitude are within the confines of the airport environment 10 and can reasonably be associated with prior location data from the same source, and may perform other error checks of the signal data, including determining if any ADS-B Out messages are missing (the messages may be transmitted every second, for example, and if enough ADS-B Out messages are missed, an error condition may exist). In block 446, the processor 75 determines if any errors were identified and checks other data contained within the ADS-B message are consistent. In block 446, if no error condition exists, the method 440 moves to block 448 and execution of the system 100 instructions causes an online signal to be sent to display 90. In block 446, if an error condition exists, the method 440 moves to block 449, and execution of the system 100 instructions causes an offline signal to be sent to the display 90. When such an error condition exists, the system 100 may not provide any advisories. Following block 449, the method 440 returns to block 442. Following block 448, the method 440 moves to block 450.

In addition to the signal integrity checks described with respect to FIG. 4D, the processor 75 may execute instructions of the health monitor system 160 to verify proper operation or function of various components of the MoRA system 100 and its associated peripherals. For example, execution of system 160 instructions may include monitoring CPU usage to determine CPU usage remains below a specified threshold or that memory utilization remains below a specified threshold. Should these and/or other component-based thresholds be exceeded, the processor 75 may execute instructions to cause an offline signal to be sent to the display 90, and the MoRA system 100 may take itself offline until the threshold settings are met.

In block 450, the processor 75 executes system 100 instructions to perform a threat analysis and to determine if a threat condition may exist or be projected to exist given ownship travel path data and travel vectors for other aircraft and ground vehicles. In block 460, the processor 75 executes system 100 instructions to identify the location and nature of the threat condition based on the threat analysis. In block 460, if a threat condition is determined, the method 400 moves to block 470 and the processor 75 executes instructions to issue an advisory appropriate for the display 90. The method 400 then returns to block 420. In block 460, if no threat is identified, the method 400 returns to block 420, and the method 400 continues until the airplane 19A leaves the surface movement area, at which point the method 400 ends.

Certain of the devices shown in FIGS. 1B(1)-3D includes a computing system. The computing system includes a processor (CPU) and a system bus that couples various system components including a system memory such as read only memory (ROM) and random access memory (RAM), to the processor. Other system memory may be available for use as well. The computing system may include more than one processor, or a group or cluster of computing systems networked together to provide greater processing capability. The system bus may be any of several types of bus structures including a memory bus or memory controller, a peripheral bus, and a local bus using any of a variety of bus architectures. A basic input/output (BIOS) stored in the ROM or the like, may provide basic routines that help to transfer information between elements within the computing system, such as during start-up. The computing system further includes data stores, which maintain a database according to known database management systems. The data stores may be embodied in many forms, such as a hard disk drive, a magnetic disk drive, an optical disk drive, tape drive, or another type of computer readable media which can store data that are accessible by the processor, such as magnetic cassettes, flash memory cards, digital versatile disks, cartridges, random access memories (RAM) and, read only memory (ROM). The data stores may be connected to the system bus by a drive interface. The data stores provide nonvolatile storage of computer readable instructions, data structures, program modules and other data for the computing system.

To enable human (and in some instances, machine) user interaction, the computing system may include an input device, such as a microphone for speech and audio, a touch sensitive screen for gesture or graphical input, keyboard, mouse, motion input, and so forth. An output device can include one or more output mechanisms. In some instances, multimodal systems enable a user to provide multiple types of input to communicate with the computing system. A communications interface generally enables the computing device system to communicate with one or more other computing devices using various communication and network protocols.

The preceding disclosure refers to flowcharts and accompanying descriptions to illustrate the embodiments represented in FIGS. 4A-4D. The disclosed devices, components, and systems contemplate using or implementing any suitable technique for performing the steps illustrated. Thus, FIGS. 4A-4D are for illustration purposes only and the described or similar steps may be performed at any appropriate time, including concurrently, individually, or in combination. In addition, many of the steps in the flow chart may take place simultaneously and/or in different orders than as shown and described. Moreover, the disclosed systems may use processes and methods with additional, fewer, and/or different steps.

Embodiments disclosed herein can be implemented in digital electronic circuitry, or in computer software, firmware, or hardware, including the herein disclosed structures and their equivalents. Some embodiments can be implemented as one or more computer programs; i.e., one or more modules of computer program instructions, encoded on computer storage medium for execution by one or more processors. A computer storage medium can be, or can be included in, a computer-readable storage device, a computer-readable storage substrate, or a random or serial access memory. The computer storage medium can also be, or can be included in, one or more separate physical components or media such as multiple CDs, disks, or other storage devices. The computer readable storage medium does not include a transitory signal.

The herein disclosed methods can be implemented as operations performed by a processor on data stored on one or more computer-readable storage devices or received from other sources.

A computer program (also known as a program, module, engine, software, software application, script, or code) can be written in any form of programming language, including compiled or interpreted languages, declarative or procedural languages, and it can be deployed in any form, including as a stand-alone program or as a module, component, subroutine, object, or other unit suitable for use in a computing environment. A computer program may, but need not, correspond to a file in a file system. A program can be stored in a portion of a file that holds other programs or data (e.g., one or more scripts stored in a markup language document), in a single file dedicated to the program in question, or in multiple coordinated files (e.g., files that store one or more modules, sub-programs, or portions of code). A computer program can be deployed to be executed on one computer or on multiple computers that are located at one site or distributed across multiple sites and interconnected by a communication network.

We claim:

1. An aircraft advisory system installed on a first aircraft operating on a movement surface of an airport, the advisory system comprising:

a cockpit display configured to provide advisories to cockpit personnel;

a receiver configured to receive surveillance signals associated with a second aircraft operating on a runway surface of the airport or on approach to the runway surface;

a processor system, comprising:

a processor, and a non-transitory, computer-readable storage medium having encoded thereon machine instructions that the processor executes to:

determine a projected path vector for the first aircraft;

determine a projected movement vector for the second aircraft, comprising:

determine a health of the advisory system, determine the health is a sufficient health, determine a quality of the surveillance signals, determine the quality is a sufficient quality, and compute the projected movement vector, comprising:

determining multiple instances of velocity and acceleration and determining latitude, longitude, and altitude of the second aircraft; and generating a three-dimensional vector projection of movement of the second aircraft based on one or more most recent instances of the velocity, acceleration, latitude, longitude, and altitude of the second aircraft, determine an existence of an interference condition between the projected path vector and the projected movement vector, comprising:

comparing the path vector with the projected movement vector; and designating the existence of the interference condition when the path vector and the projected movement vector cross within a specified threshold, and issue an advisory indicating the interference condition for rendering on the cockpit display, wherein to further determine the quality of the surveillance signals, the processor determines that multiple instances of the projected movement vector follow a consistent path by comparing the latitude, longitude, and altitude of each of the multiple instances.

2. The advisory system of claim 1, wherein the advisory comprises one or more of a text, an audio signal, a visual signal, and a moving map displaying the path vector, the projected movement vector and a projected intersection of the vectors.

3. The advisory system of claim 1, wherein the advisory system is implemented in an electronic flight bag (EFB).

4. The advisory system of claim 1, wherein the surveillance signals comprise ADS-B Out signals and the receiver comprises an ADS-B In receiver.

5. The advisory system of claim 4, wherein to determine the quality of the surveillance signals, the processor processes an error correction code included with one or more of the surveillance signals providing error correction codes.

6. The advisory system of claim 4, wherein the surveillance signals comprises multiple types of a surveillance signal, and wherein to determine the quality of a given type of a surveillance signal, the processor determines a frequency of reception of multiple instances of surveillance signals of a given type over time.

7. The advisory system of claim 4, wherein the surveillance signal is an ADS-B signal, and wherein to determine the quality of the ADS-B signal, the processor:

reads velocity and acceleration provided in the ADS-B signal;

computes velocity and acceleration based on latitude, longitude, speed, and altitude provided in the ADS-B signal; and compares the read velocity and acceleration to the computed velocity and accelerations to determine a sufficient correspondence between read values and computed values.

8. The advisory system of claim 1, wherein the processor:

provides an offline indication when the determined quality is below a threshold value or the determined health is below a threshold value, wherein the processor does not provide an advisory, and provides an online signal otherwise.

9. The advisory system of claim 1, wherein the receiver comprises a software-defined radio.

10. The advisory system of claim 1, wherein the receiver comprises a GPS receiver installed on the first aircraft, wherein the GPS receiver computes position, velocity, and acceleration of the first aircraft.

11. The advisory system of claim 1, wherein the surveillance signals comprise ADS-B Out signals broadcast by a base station.

12. The advisory system of claim 11, wherein the surveillance signals further comprise surface surveillance system radar signals and airport surveillance radar signals.

13. A method for operating advisory system to issue aircraft interference advisories to an aircraft operating on a movement area of an airport, comprising:

a processor onboard a first aircraft operating on the movement area processing surveillance signals received at the first aircraft and related to a second aircraft operating on the movement area or on approach to the movement area, comprising:

determining a projected movement vector for the second aircraft, comprising:

determining a health of the advisory system, determining the health is a sufficient health, determining a quality of the surveillance signals, determining the quality is a sufficient quality, and computing the projected movement vector, comprising:

extracting second aircraft three-dimensional position data from the received surveillance signals;

determining multiple instances of position, velocity and acceleration of the second aircraft; and generating a three-dimensional vector projection of movement of the second aircraft based on one or more most recent instances of the three-dimensional position data and the velocity and acceleration of the second aircraft, determining a projected path vector for the first aircraft, comprising:

receiving ownship data for the first aircraft, repetitively determining location and computing velocity and acceleration of the first aircraft, and computing a projection of first aircraft movement based on one or more of the determinations of location and computations of velocity and acceleration of the first aircraft;

determining an existence of an interference condition between the projected path vector and the projected movement vector, comprising:

comparing the path vector with the projected movement vector, and designating the existence of the interference condition when the path vector and the projected movement vector cross within a specified threshold; and rendering on a cockpit display of the first aircraft, an advisory indicating the interference condition, wherein to further determine the quality of the surveillance signals, the processor determines that multiple instances of the projected movement vector follow a consistent path by comparing the determined position, velocity and acceleration of the second aircraft for an instance to the determined position, velocity and acceleration of the second aircraft for one or more preceding instances.

14. The method of claim 13, wherein determining velocity and acceleration of the second aircraft comprises extracting speed, heading, and altitude change data from the surveillance signals.

15. The method of claim 13, further comprising the processor displaying the projected path vector and the projected movement vector on a moving map of the airport.

16. An aircraft advisory system, comprising:

a receiver installed on a first aircraft and configured to receive multiple types of surveillance signals;

a cockpit-area display system installed on the first aircraft and configured to render advisories; and a non-transitory, computer-readable storage medium installed on the first aircraft and having encoded thereon instructions for processing the received surveillance signals and providing advisory data to the display system, wherein a processor installed on the first aircraft executes the instructions to:

compute a path vector projection for a first aircraft operating on a movement area of an airport, comprising:

receiving ownship data related to first aircraft position and movement; and determining first aircraft heading, speed, and acceleration based on the received ownship data, and compute a movement vector projection for a second aircraft operating in a vicinity of the airport, comprising receiving at the receiver, a plurality of surveillance signals associated with the second aircraft, the surveillance signals corresponding to one of multiple types of surveillance signals, comprising:

determining a quality factor associated with the received surveillance signals of a given type of surveillance signal is equal to or greater than a minimum required quality value, comprising:

determining the received surveillance signals of the given type are received from a single aircraft, and determining any error correction code values in the received surveillance signals of the given type;

determining a health of the advisory system is equal to or greater than a minimum required health value, comprising:

determining sufficient memory, and processing speed for processing the received surveillance signals of the surveillance signal, and determining sufficient CPU utilization available for processing the received surveillance signals;

processing the received surveillance signals of the given type to determine a three-dimensional movement vector projection for the second aircraft, comprising determining second aircraft projected velocity, acceleration, and position, determining that multiple instances of the projected movement vector follow a consistent path by comparing the determined position, velocity and acceleration of the second aircraft for an instance to the determined position, velocity and acceleration of the second aircraft for one or more preceding instances, and provide advisory data for rendering on the cockpit area display system.

17. The aircraft advisory system of claim 16, wherein the surveillance signals comprise ASD-B signals and the system comprises an ADS-B Out receiver.

18. The aircraft advisory system of claim 17, wherein the ADS-B signals are provided from one of an ADS-B aircraft and an ADS-B ground station, and the receiver comprises one of an ADS-B receiver and a software-defined radio.

* * * * *